US006942546B2

(12) United States Patent
Desai et al.

(10) Patent No.: US 6,942,546 B2
(45) Date of Patent: Sep. 13, 2005

(54) ENDPOINT DETECTION FOR NON-TRANSPARENT POLISHING MEMBER

(75) Inventors: Mukesh Desai, Milpitas, CA (US); Yuchun Wang, San Jose, CA (US); Efrain Velazquez, Los Angeles, CA (US)

(73) Assignee: ASM Nutool, Inc., Fremont, CA (US)

( * ) Notice: Subject to any disclaimer, the term of this patent is extended or adjusted under 35 U.S.C. 154(b) by 0 days.

(21) Appl. No.: 10/321,150

(22) Filed: Dec. 17, 2002

(65) Prior Publication Data

US 2003/0153246 A1 Aug. 14, 2003

Related U.S. Application Data

(63) Continuation-in-part of application No. 10/105,016, filed on Mar. 22, 2002, and a continuation-in-part of application No. 10/052,475, filed on Jan. 17, 2002, now Pat. No. 6,908,374.

(60) Provisional application No. 60/417,544, filed on Oct. 10, 2002, and provisional application No. 60/414,579, filed on Sep. 27, 2002.

(51) Int. Cl.[7] ..... B24B 49/12; B24B 7/22

(52) U.S. Cl. ..... 451/8; 451/6; 451/59; 451/288; 451/296

(58) Field of Search ..... 451/5–8, 28, 41, 451/59

(56) References Cited

U.S. PATENT DOCUMENTS

| | | | | |
|---|---|---|---|---|
| 4,142,107 A | | 2/1979 | Hatzakis | |
| 5,558,568 A | | 9/1996 | Talieh et al. | |
| 5,605,760 A | | 2/1997 | Roberts | |
| 5,733,182 A | | 3/1998 | Muramatsu et al. | |
| 5,762,536 A | | 6/1998 | Pant et al. | |
| 5,916,012 A | | 6/1999 | Pant et al. | |
| 6,025,015 A | | 2/2000 | Landry-Coltrain et al. | |
| 6,066,030 A | * | 5/2000 | Uzoh | 451/41 |
| 6,071,818 A | | 6/2000 | Chisholm et al. | |
| 6,146,248 A | | 11/2000 | Jairath et al. | |
| 6,204,922 B1 | * | 3/2001 | Chalmers | 356/630 |
| 6,228,280 B1 | | 5/2001 | Li et al. | |
| 6,241,583 B1 | | 6/2001 | White | |
| 6,241,585 B1 | | 6/2001 | White | |
| 6,244,935 B1 | | 6/2001 | Birang et al. | |
| 6,248,000 B1 | | 6/2001 | Aiyer | |
| 6,258,205 B1 | | 7/2001 | Chisholm et al. | |
| 6,261,959 B1 | | 7/2001 | Travis et al. | |
| 6,271,047 B1 | * | 8/2001 | Ushio et al. | 438/14 |
| 6,302,767 B1 | | 10/2001 | Tietz | |
| 6,322,427 B1 | | 11/2001 | Li et al. | |
| 6,383,332 B1 | | 5/2002 | Shelton et al. | |
| 6,406,363 B1 | | 6/2002 | Xu et al. | |
| 6,447,369 B1 | * | 9/2002 | Moore | 451/6 |
| 6,475,070 B1 | | 11/2002 | White | |
| 6,514,775 B2 | * | 2/2003 | Chen et al. | 438/8 |
| 6,517,413 B1 | * | 2/2003 | Hu et al. | 451/6 |
| 6,607,422 B1 | * | 8/2003 | Swedek et al. | 451/6 |
| 6,609,947 B1 | * | 8/2003 | Moore | 451/5 |
| 6,620,031 B2 | * | 9/2003 | Renteln | 451/41 |
| 6,629,874 B1 | * | 10/2003 | Halley | 451/6 |
| 6,664,557 B1 | * | 12/2003 | Amartur | 250/559.27 |
| 6,670,200 B2 | * | 12/2003 | Ushio et al. | 438/14 |
| 6,722,946 B2 | * | 4/2004 | Talieh et al. | 451/8 |
| 2001/0036676 A1 | * | 11/2001 | Mitsuhashi et al. | 438/8 |
| 2002/0127950 A1 | * | 9/2002 | Hirose et al. | 451/6 |
| 2004/0201012 A1 | * | 10/2004 | Faris | 257/40 |

FOREIGN PATENT DOCUMENTS

| | | | | |
|---|---|---|---|---|
| JP | 2000183002 A | * | 6/2000 | H01L/21/304 |

* cited by examiner

*Primary Examiner*—David B. Thomas
(74) *Attorney, Agent, or Firm*—Knobbe, Martens, Olson & Bear, LLP

(57) ABSTRACT

A sensing apparatus for detecting a processing endpoint of a multi-layer semiconductor wafer includes a light source to emit light against a surface of the semiconductor wafer, a color sensor to sense a reflection color from the surface of the semiconductor wafer in response to the incident light and to generate a sensor signal, and a decision circuit coupled to the color sensor and configured to decide whether the wafer processing endpoint has been reached based at least in part on the sensor signal. In another embodiment, a sensing apparatus is coupled to a movable structure to position the sensing apparatus to sense the surface of the semiconductor wafer.

20 Claims, 20 Drawing Sheets

DISTANCE ON THE PLATE

DISTANCE ON THE PLATE

ENDPOINT DETECTION FOR NON-TRANSPARENT POLISHING MEMBER

CROSS REFERENCE TO RELATED APPLICATIONS

This is a continuation-in-part U.S. Ser. No. 10/105,016 filed Mar. 22, 2002 (NT-250-US) and U.S. Ser. No. 10/052,475, filed Jan. 17, 2002 now U.S. Pat. No. 6,908,374 (NT-238-US), both incorporated herein by reference.

This application claims priority to U.S. Prov. No. 60/417,544 filed Oct. 10, 2002 (NT-278-P2) and U.S. Prov. No. 60/414,579 filed Sep. 27, 2002 (NT-278-P), both incorporated herein by reference.

FIELD

The present invention relates to manufacture of semiconductor integrated circuits and more particularly to a method of chemical mechanical polishing of conductive and insulating layers using endpoint detection.

BACKGROUND

Conventional semiconductor devices generally include a semiconductor substrate, usually a silicon substrate, and a plurality of sequentially formed dielectric interlayers such as silicon dioxide and conductive paths or interconnects made of conductive materials. Copper and copper alloys have recently received considerable attention as interconnect materials because of their superior electromigration and low resistivity characteristics. Interconnects are usually formed by filling copper in features or cavities etched into the dielectric interlayers by a metallization process. The preferred method of copper metallization process is electroplating. In an integrated circuit, multiple levels of interconnect networks laterally extend with respect to the substrate surface. Interconnects formed in sequential layers can be electrically connected using vias or contacts. In a typical process, first an insulating layer is formed on the semiconductor substrate. Patterning and etching processes are performed to form features such as trenches and vias in the insulating layer. After coating features on the surface with a barrier and then a seed layer, copper is electroplated to fill the features. However, the plating process, in addition to the filling the features, also results in a copper layer on the top surface of the substrate. This excess copper is called overburden and it should be removed before the subsequent process steps.

FIG. 1A shows an exemplary portion 8 of such plated substrate 9, for example a silicon wafer. It should be noted that the substrate 9 may include devices or other metallic and semiconductor sections, which are not shown in FIG. 1A for the purpose of clarification. As shown in FIG. 1A, features such as a via 10, and a trench 12 are formed in an insulation layer 14, such as a silicon dioxide layer, that is formed on the substrate 9. The via and the trench 12 as well as top surface 15 of the insulation layer 14 are covered and filled with a deposited copper layer 16 through an electroplating process. Conventionally, after patterning and etching, the insulation layer 14 is first coated with a barrier layer 18, typically, a Ta or Ta/TaN composite layer. The barrier layer 18 coats the via and the trench as well as the surface 15 of the insulation layer to ensure good adhesion and acts as a barrier material to prevent diffusion of the copper into the semiconductor devices and into the insulation layer. Next a seed layer (not shown), which is often a copper layer, is deposited on the barrier layer. The seed layer forms a conductive material base for copper film growth during the subsequent copper deposition. As the copper film is electroplated, the deposited copper layer 16 quickly fills the via 10 but coats the wide trench 12 and the top surface 15 in a conformal manner. When the deposition process is continued to ensure that the trench is also filled, a copper layer or overburden is formed on the substrate 9. Conventionally, after the copper plating, various material removal processes, for example, chemical mechanical polishing (CMP), etching or electroetching, can be used to remove the unwanted overburden layer.

The CMP process conventionally involves pressing a semiconductor wafer or other such substrate against a moving polishing surface that is wetted with a polishing slurry. The slurries may be basic, neutral or acidic and generally contain alumina, ceria, silica or other hard abrasive ceramic particles. The polishing surface is typically a planar pad made of polymeric materials well known in the art of CMP. Some polishing pads contain abrasive particles (fixed abrasive pads). These pads may be used in conjunction with CMP solutions that may not contain any abrasive particles. The polishing slurry or solution may be delivered to the surface of the pad or may be flowed through the pad to its surface if the pad is porous. During a CMP process a wafer carrier holds a wafer to be processed and places the wafer surface on a CMP pad and presses the wafer against the pad with controlled pressure while the pad is rotated. The pad may also be configured as a linear polishing belt that can be moved laterally as a linear belt. The process is performed by moving the wafer against the pad, moving the pad against the wafer or both as polishing slurry is supplied to the interface between the pad and the wafer surface.

As shown in FIG. 1B, CMP is first applied to reduce the thickness of the copper layer down to the barrier layer 18 that covers the top surface 15 of the insulation layer 14. Subsequently, the barrier layer 18 on the top surface is removed to confine the copper and the remaining barrier in the vias 10, 12 and trenches 13. However, during these processes, determining the polishing endpoint, whether the copper layer is polished down to the barrier layer or the barrier layer is polished down to the insulation layer, is one of the important problems in the industry.

U.S. Pat. No. 5,605,760 describes a polishing pad that is made of solid uniform polymer sheet. The polymer sheet is transparent to light at a specified wavelength range. The surface of the polymer sheet does not contain any abrasive material and does not have any intrinsic ability to absorb or transport slurry particles.

More recently, endpoint detection systems have been implemented with rotating pad or linear belt systems having a window or windows in them. In such cases as the pad or the belt moves, it passes over an in-situ monitor that takes reflectance measurements from the wafer surface. Changes in the reflection indicate the endpoint of the polishing process. However, windows opened in the polishing pad can complicate the polishing process and may disturb the homogeneity of the pad or the belt. Additionally, such windows may cause accumulation of polishing byproducts and slurry.

Therefore, a continuing need exists for a method and apparatus which accurately and effectively detects an endpoint on a substrate when the substrate is polished using the CMP processes.

As shown in FIG. 1B, CMP is first applied to reduce the thickness of the copper layer down to the barrier layer 18 that covers the top surface 15 of the insulation layer 14. Subsequently, the barrier layer 18 on the top surface is removed to confine the copper and the remaining barrier in the via 10 and trench 12. However, during these processes, uniform reduction of the thickness of the polished copper layer is one of the important problems in the industry. The thickness uniformity of the metal layer must be maintained while it is processed so that the overpolish after copper endpoint is minimized and the substrate is not over-polished, since overpolishing may cause excessive dishing, erosion and other defects. Further, underpolishing of the copper layer and barrier layers may cause electrical shorts or other defects. The non-uniformity during the polishing process may be due to either a non-uniform polishing process or a non-uniform thickness of the metal layers on the substrate or both.

Polishing of insulator layers of a substrate is another application of CMP. Shallow trench isolation (STI) is a process by which insulating trenches are formed in the surface of the substrate to prevent electromigration between neighboring circuits. The trenches are typically filled with silicon nitride ($Si_3N_4$) and silicon dioxide ($SiO_2$). To fill the trenches, a layer of silicon nitride is first deposited on the surface of the substrate, followed by an overlying layer of silicon dioxide. Excess silicon dioxide and silicon nitride must be removed from the surface of the substrate, leaving a smooth layer of silicon nitride over most of the substrate surface and layers of silicon dioxide and silicon nitride filling the trench area. The removal of excess silicon dioxide and silicon nitride is typically performed by CMP.

FIG. 1C shows a cross-sectional view of an exemplary portion 51 of a substrate 52, for example a silicon wafer, that is covered with two layers of insulating material. A trench 53, suitable for STI, is formed in the surface of the substrate 52. A bottom insulating layer 54 and a top insulating layer 55 cover the surface of the substrate 52, including the trench 53. The composition of the bottom insulating layer 54 and the top insulating layer 55 may be, for example, silicon nitride and silicon dioxide respectively. Note that the insulating layers 54 and 55 cover the entire surface of the substrate 52. To complete the STI process, excess insulating material must be removed.

FIG. 1D shows a cross-sectional view of the exemplary portion 51 of the substrate 52 after the insulating layers 54 and 55 have been polished to a desired degree, i.e., after excess insulating material has been removed. The polishing of the insulating layers may be performed by, for example, CMP. Note that a smooth layer of the insulating layer 54, i.e. silicon nitride covers the surface of the substrate 52 and that the insulating layers 54 and 55 (i.e., silicon nitride and silicon dioxide) fill the trench 53.

Problems with current STI technology include a difficulty in performing silicon dioxide thickness measurement by optical interferometry because the thickness measurement signal repeats itself periodically with increasing or decreasing silicon dioxide thickness. Additionally, the thickness measurement signal is sensitive to environmental factors such as moisture (water film) and detect angle.

An additional problem with current technology is that conventional metrology tools require that a substrate be removed from its carrier head to perform endpoint detection.

A uniform polishing process will significantly reduce CMP cost while increasing process throughput. As the wafer sizes become larger, e.g., 300 mm and beyond, a planar reduction of thickness in a uniform manner becomes more difficult due to the larger surface area of the wafer.

Consequently, there is need for an improved method and apparatus for monitoring and maintaining the uniformity of the polished layer when the substrate is polished using CMP processes.

SUMMARY

The present invention advantageously provides a polishing method and apparatus for controlling planarity in material removal processes such as CMP. One embodiment of the invention includes the ability to perform endpoint detection in such a material removal process. Another embodiment provides a smart endpoint detection along with a pressure control technique that can selectively apply polishing pressure to particular zones on a workpiece.

A chemical mechanical polishing (CMP) apparatus for polishing a surface of a workpiece and for detecting a CMP endpoint is presented according to an aspect of the present invention. The CMP apparatus includes an optically transparent polishing member, a workpiece holder, a support plate, and an optical detection system. The polishing member may be, for example, a polishing belt, a polishing pad, or another type of polishing member. The polishing member, preferably including abrasive particles, polishes the surface of the workpiece and is movable in one or more directions (preferably linear directions, but can also be in other directions as well, e.g. circular). The workpiece holder supports the workpiece and is configured to press the workpiece against the polishing member. The support plate is adapted to support the polishing member as the workpiece is pressed against the polishing member. The optical detection system detects the CMP endpoint and is disposed below the polishing member. The optical detection system includes a light source and a detector. The light source sends outgoing signals through the support plate and the polishing member to the surface of the workpiece. The detector receives incoming reflected signals from the surface of the workpiece through the polishing member and the support plate.

A method of polishing a surface of a workpiece and of detecting a chemical mechanical polishing (CMP) endpoint is presented according to another aspect of the present invention. According to the method, the workpiece is pressed against an optically transparent polishing member. The polishing member is supported by a support plate. The surface of the workplace is polished with the polishing member. The polishing member is movable in one or more linear directions. Outgoing optical signals are sent from a light source through the support plate and the polishing member to the surface of the workpiece. The light source is disposed below the polishing member so that the polishing member is between the light source and the surface of the workpiece. Incoming reflected optical signals are received from the surface of the workpiece through the polishing member and the support plate at a detector. The detector is disposed below the polishing member.

A method of polishing one or more workpieces and of providing chemical mechanical polishing (CMP) endpoint detection is presented according to a further aspect of the present invention. According to the method, an optically transparent polishing member is provided between a supply area and a receive area. The polishing member has a first end and a second end and a polishing side and a backside. The first end initially comes off the supply area and is connected to the receive area and the second end remains connected to the receive area. A first workpiece is polished by moving a portion of the polishing member in one or more linear directions within a polishing area. A first CMP endpoint of the first workpiece is detected using an optical detection system. The optical detection system sends outgoing signals to and receives incoming reflected signals from the first workpiece through the polishing member. The polishing member is located between the optical detection system and the first workpiece.

A CMP apparatus for polishing a surface of a workpiece and for detecting a CMP endpoint is presented according to another aspect of the present invention. The CMP apparatus includes a supply spool and a receiving spool, an optically transparent polishing member, a processing area, a means for moving a section of the polishing member in one or more linear directions, and a means for detecting a CMP endpoint. The polishing member has two ends. One end is attached to the supply spool and the other end is attached to the receiving spool. The processing area has a section of the polishing member in between the two ends. The means for detecting the CMP endpoint sends optical signals to, and receives reflected optical signals from, the surface of the workpiece through the polishing member. The polishing member is located between the means for detecting and the workpiece.

A method of polishing a surface of a workpiece and of detecting a CMP endpoint is presented according to a further aspect of the present invention. According to the method, the workpiece is supported such that the surface of the workpiece is exposed to a section of an optically transparent polishing member in a processing area. The surface of the wafer is polished by moving the section of the polishing member bidirectional linearly. A CMP endpoint is determined for the workpiece by sending outgoing optical signals through the polishing member to the workplace and continuously examining the relative intensity of incoming optical signals reflected from the workpiece and received through the polishing member. The foregoing discussion of aspects of the invention has been provided only by way of introduction. Nothing in this section should be taken as a limitation on the following claims, which define the scope of the invention.

A second exemplary embodiment of the invention includes a polishing station having a workpiece holder, and a flexible polishing member. The polishing member is held against the workpiece by a platen that supplies a fluid against the backside of the polishing member. The platen includes a number of holes for supplying the fluid and also includes a number of sensors that can detect the endpoint of the workpiece processing. The holes are grouped together to create pressure zones and typically one sensor is associated with each zone, but there may be more or less. A computer receives the sensor signals and controls the fluid flow to optimize the polishing. If, for example, a certain location on the workpiece reaches the endpoint, the computer reduces the fluid flow to that location while maintaining the fluid flow to other areas.

In another exemplary embodiment of the invention, a sensing apparatus for detecting a processing endpoint of a multi-layer semiconductor wafer includes a light source to emit light against a surface of the semiconductor wafer, a color sensor to sense a reflection color from the surface of the semiconductor wafer in response to the incident light and to generate a sensor signal, and a decision circuit coupled to the color sensor and configured to decide whether the wafer processing endpoint has been reached based at least in part on the sensor signal.

In yet another exemplary embodiment of the invention, an endpoint detection system for detecting a processing endpoint of a semiconductor wafer includes a sensing apparatus configured to sense a metric related to a surface of the semiconductor wafer and to generate a sensor signal based upon the metric. The endpoint detection system also includes a decision circuit coupled to the sensing apparatus and configured to decide whether the wafer processing endpoint has been reached based at least in part on the sensor signal and a movable structure coupled to the sensing apparatus to position the sensing apparatus to sense the metric.

In still another exemplary embodiment of the invention, a method for detecting a processing endpoint of a multi-layer semiconductor wafer includes emitting light against a surface of the semiconductor wafer, sensing a reflection color from the surface of the semiconductor wafer in response to the incident light, generating a sensor signal based upon the sensing of the reflection color, and determining whether the wafer processing endpoint has been reached based at least in part on the sensor signal.

In one aspect of the invention, the fluid controller independently controls the fluid flow to the pressure zones. One feature of this aspect is that the invention can also selectively exhaust fluid from certain holes in the platen to reduce, and even negatively influence, the pressure zones.

In another aspect of the invention, the workpiece is rotated during processing and the platen holes are located concentrically and each concentric ring represents a pressure zone.

In another aspect of the invention, the fluid controller independently controls the fluid flow to the concentric rings on the platen.

In another aspect of the invention, the polishing member is optically transparent.

In another aspect of the invention, the polishing member includes windows.

In another aspect of the invention, the sensors are light sensors.

In another aspect of the invention, the sensors are acoustic thickness sensors.

In another aspect of the invention, the sensors are color sensors.

In another aspect of the invention, the sensor is attached to a movable structure.

In another aspect of the invention, the sensors use fiber optic threads.

In another aspect of the invention, the workpiece is kept substantially stationary, but may be rotationally and translationally moved during the polishing process. In a preferred aspect of the invention, the translational movement is smaller than a pressure zone area.

Advantages of the invention include the ability to optimally polish the workpiece, thereby saving time and money.

BRIEF DESCRIPTION OF THE DRAWINGS

The foregoing and other features, aspects, and advantages will become more apparent from the following detailed description when read in conjunction with the following drawings, wherein.

DETAILED DESCRIPTION

As will be described below, the present invention provides a method and a system for an in-situ endpoint detection for material removal processes such as CMP. Reference will now be made to the drawings wherein like numerals refer to like parts throughout.

A. Endpoint Detection System

Figure 1A:
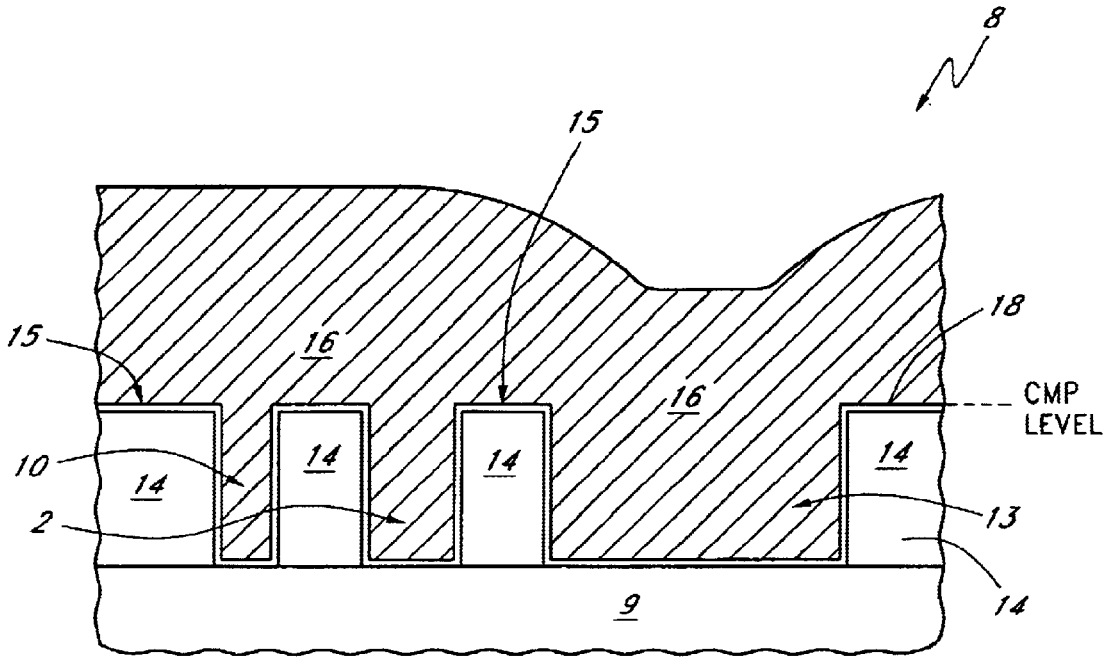
FIG. 1A is a diagram illustrating a cross-sectional view of an exemplary substrate following deposition of material onto the surface of the substrate.
Figure 1B:
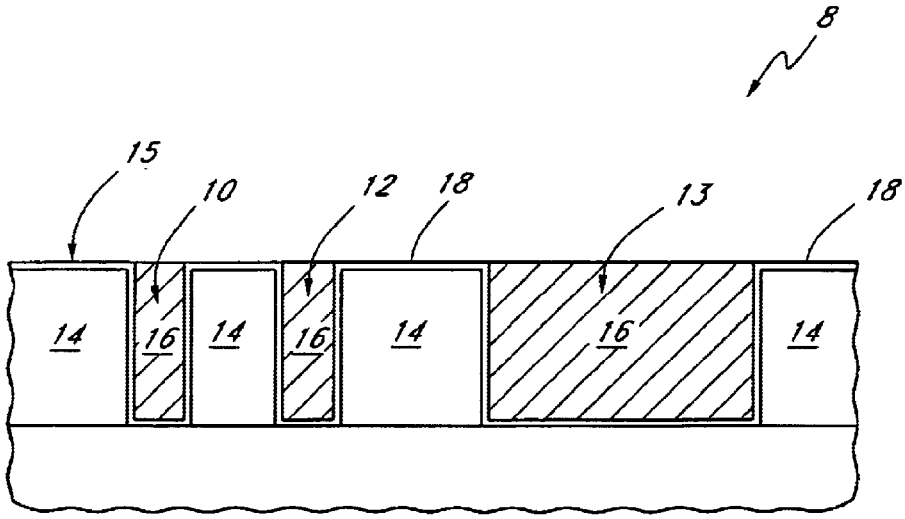
FIG. 1B is a diagram illustrating a cross sectional view of the exemplary substrate of FIG. 1A following a conventional CMP process.
Figure 2:
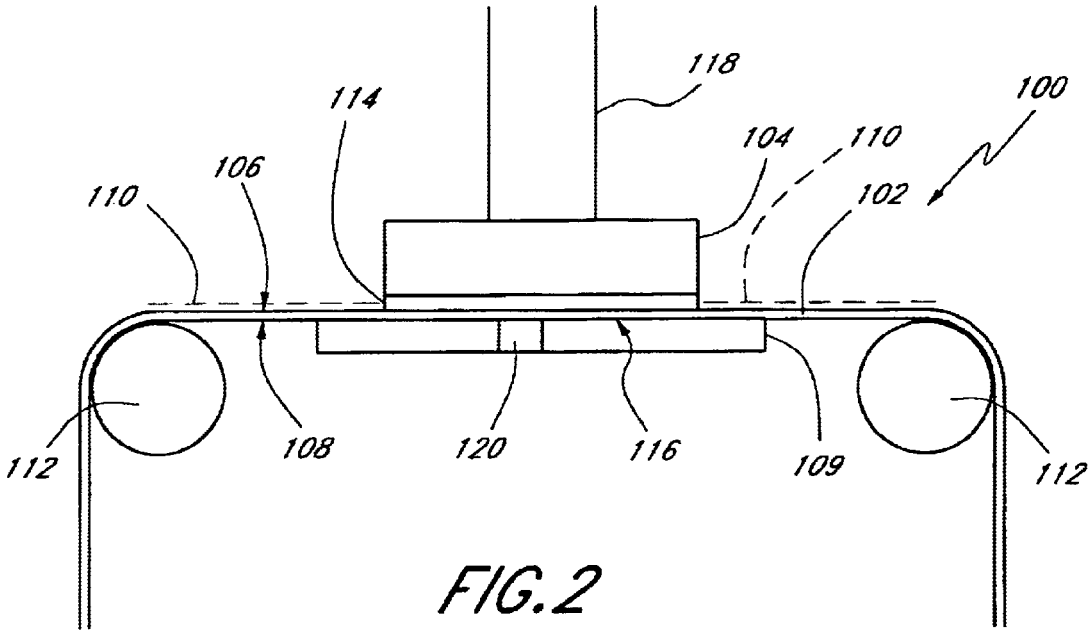
FIG. 2 is a diagram illustrating a cross sectional side view of an exemplary CNU system including an exemplary endpoint detection system according to a presently preferred embodiment used for processing workpieces such as wafers.

FIG. 2 shows an exemplary chemical mechanical polishing (CMP) apparatus 100 that includes a polishing member 102 and a carrier head 104. The polishing member may be, for example, a polishing belt, a polishing pad, or another type of polishing member. The polishing member 102 includes an upper or process surface 106 and a lower surface 108. The lower surface 108 of the polishing member is placed and tensioned on a support plate 109 such as a platen. The polishing member and head are positioned so that the face of the workpiece is adjacent to the polishing member, which could be proximate or touching the polishing member. In this embodiment, the polishing member 102 is an optically transparent polishing member. A polishing solution 110 is flowed on the process surface 106 of the polishing member 102, and the polishing member is moved over a set of rollers 112 either in unidirectional or bidirectional manner by a moving mechanism (not shown). In this embodiment, the polishing member is moved in a bidirectional manner. The polishing solution 110 may be a copper polishing solution or an abrasive polishing slurry. The solution 110 may be fed from one or both sides of the wafer onto the polishing member, or it may also be fed onto the wafer surface through the polishing member, or both. A wafer 114 to be processed is held by the carrier head 104 so that a front surface 116 of the wafer, which will be referred to as surface hereinafter, is fully exposed. The head 104 may move the wafer vertically up and down as well as rotate the wafer 114 through a shaft 118. The surface 116 of the wafer 114 may have the structure shown in FIG. 1A with a copper layer 16 (that includes both the seed layer and the deposited copper) that can be polished down to the barrier layer 18 therebelow (as shown FIG. 1B), while the endpoint detection is performed in-situ using the present invention. In this example, the overburden layer is copper (Cu), the barrier layer 18 is tantalum (Ta). The insulation layer 14 may be made of silicon dioxide ($SiO_2$) or a low-k dielectric or ultra low-k dielectric materials. In this embodiment, an endpoint monitoring device 120, preferably comprising an optical emitter and detector, is placed under the polishing member 102. The endpoint monitoring device 120 detects the polishing endpoint, when the copper layer is polished down to the barrier layer 18 on the top surface 15 of the insulation layer (see FIGS. 1A–1B). As soon as the barrier layer is exposed and detected by the device 120, the process is halted. In an optional step, if desired, the process may be continued until the barrier layer is polished down to the underlying oxide layer. As will be described below, the device 120 may be placed in a cavity in the platen 109. The device 120 of the present invention can be any optical monitoring device that is used to monitor changes in reflectivity. Although copper is used as an example material herein, the present invention may also be used in the removal of other materials, for example conductors such as Ni, Pd, Pt, Au, Pb, Sn, Ag, and their alloys, Ta, TaN, Ti and TiN, as well as insulators and semiconductors. During the process, the wafer 114 is rotated and the surface 116 is contacted by the process surface 106 of the polishing member 102 that is moved while the polishing solution 110 is flowed on the process surface 106 and wets the surface 116 of the wafer.

Figure 3:
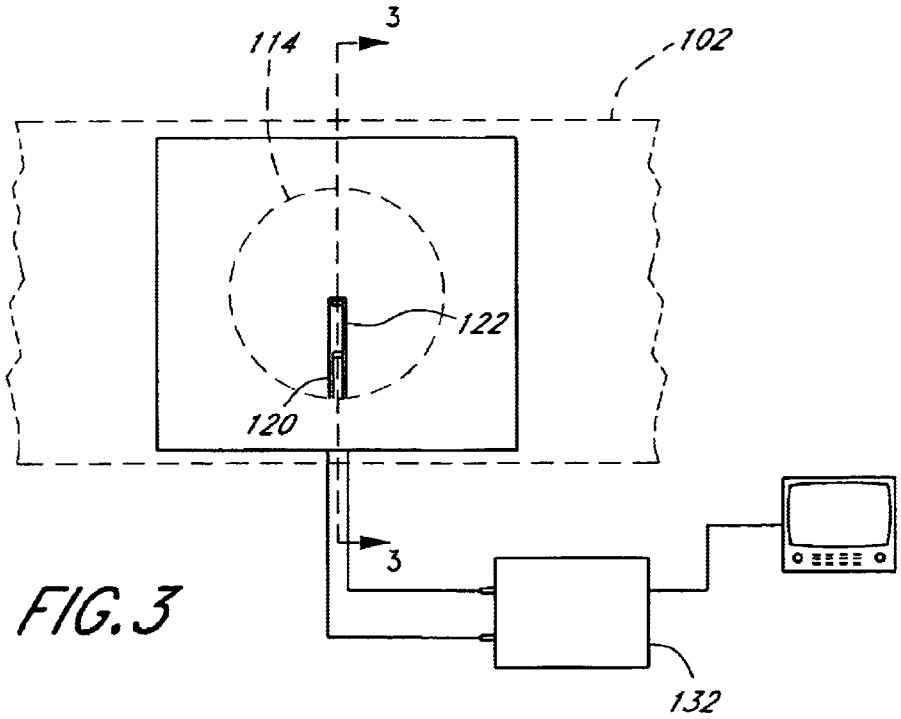
FIG. 3 is a diagram illustrating a cross-sectional top view of the exemplary CMP system of FIG. 4 and an exemplary control system for the endpoint detection system according to aspects of the present invention.
Figure 4:
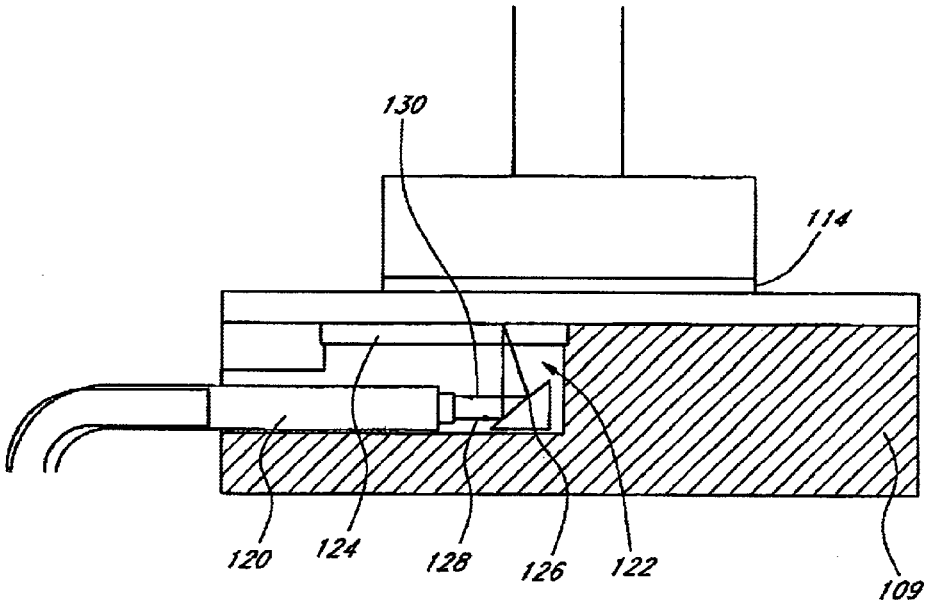
FIG. 4 is a diagram illustrating a cross sectional side view of the exemplary CMP system including the exemplary endpoint detection system of FIG. 2.

As illustrated in FIG. 3, in a plan view and also FIG. 4 in cross section, the monitoring device 120 is placed in a cavity 122 formed in the platen 109. As shown in FIG. 4, top of the cavity 122 can be sealed by a transparent window 124. In this embodiment, the cavity 122 is sized and shaped to accommodate movement of the elongate body of the monitoring device along the cavity 122. Position of the cavity 122 is correlated with the relative position of the wafer on the polishing member and the underlying platen. During the process, the monitoring device may be moved along the cavity by a moving mechanism (not shown) to scan the radius of the wafer. As a result of scanning action various locations between the edge of the wafer and the center of the wafer is monitored. The cavity could be extended beyond the center of the wafer so that a wide spectrum of reading can be done along, for example, the diameter of the wafer by sliding the monitoring device in the cavity so as to generate a scanning action, as the wafer is rotated. This scanning procedure can be performed as a continuous process, or in steps.

In this embodiment, a mirror 126 attached to the monitoring device enables outgoing optical signal 128 to project on the wafer surface. The mirror 126 then allows incoming reflected optical signal 130 or reflected optical signal to reach the monitoring device 120. In alternative embodiments, using monitoring devices with different configurations, such as flexible micro fibers, may eliminate the use of a mirror, and the signals may be directly sent from the device to the copper surface. The device determines endpoint, that is, the instant that the barrier layer 18 is exposed (see FIG. 1B), when the intensity of the reflected signal 130 changes. If the CMP process is continued to remove the barrier layer, the intensity of the reflected signal is again changed when the top surface 15 of the insulating layer 14 is exposed (see FIG. 1B). The optical signals generated by the monitoring device or directed by it may have wavelength range of 600–900 manometers. The outgoing optical signal may be generated by an emitter of the device 120, such as a white light emitter with a chopper or a LED or laser. According to a presently preferred embodiment, the reflected optical signal is received by a detector of the device 120. An exemplary detector can be a pyroelectric detector. Incoming optical signal may first pass through a bandpass filter set up to eliminate substantially all wavelengths but the one that is detected by the detector. In this embodiment, the outgoing and the reflected signals advantageously travels through the polishing member which is optically transparent. Another alternative embodiment is to place an array of multiple monitoring devices fixed in the radially formed cavities extending from a center of the plate (star shape), which may correspond to the center of the wafer, to monitor the signal change on the wafer surface. Again, alternatively, a number of monitoring devices may be distributed along a single cavity. In this way, the monitoring devices may collect data from the center, middle, and edge areas of the rotating wafer surface.

According to an aspect of the present invention, the whole polishing member is made of transparent materials and no extra window is needed for the endpoint detection. In this embodiment the polishing member comprises a composite structure having a top transparent abrasive layer formed on a transparent backing material. An abrasive layer contacts the workpiece during the process and includes fine abrasive particles distributed in a transparent binder matrix. An exemplary linear polishing member structure used with the present invention may include a thin coating of transparent abrasive layer, for example 5 $\mu$m to 100 $\mu$m thick, stacked on a transparent Mylar backing, which material is available from Mipox, Inc., Hayward, Calif. The abrasive layer may be 5 $\mu$m to 100 $\mu$m thick while the backing layer may be 0.5 to 2 millimeter thick. Size of the abrasive particles in the abrasive layer are in the range of approximately 0.2 to 0.5 $\mu$m. An exemplary material for the particles maybe silica, alumina or ceria. A less transparent polishing member, but still usable with the present invention, is also available from 3M Company, Minnesota. While in some embodiments the polishing member can include abrasive particles, the polishing member can also be made of transparent polymeric materials without abrasive particles.

As described above, as the abrasive polishing member removes materials from the wafer surface and as the barrier layer or the oxide layer is exposed, the reflected light intensity changes. In one example, a transparent polishing member having approximately 10 $\mu$m thick abrasive layer and 0.5 to 1.0 millimeter thick transparent Mylar layer was used. In this example, the abrasive layer had 0.2 to 0.5 $\mu$m fumed silica particles. A light beam (outgoing) of 675 nanometer wavelength was sent through this polishing member and the intensity changes throughout the CMP process were monitored. With this polishing member, it was observed that throughout the copper removal process, the intensity of the reflected light kept an arbitrary (normalized) intensity value of 2. However, as soon as the barrier layer (Ta layer) was exposed the intensity value was reduced to 1. Further, when the barrier layer was removed from the top of the oxide layer and the oxide layer was exposed, the intensity of the reflected light was reduced to 0.5.

As shown in FIG. 3, in the preferred embodiment, the monitoring device 120 is connected to a computer 132, which computer may also be electrically connected to a carrier head controller (not shown), although it is understood that the computation could be performed in many manners, and need not necessarily require a computer with a processor, but instead could use discrete or integrated logic circuits, including but not limited to ASICS and programmable gate arrays. When operating on a copper layer with a barrier layer beneath, as soon as the barrier layer is exposed, the output signal from the monitoring device changes as a result of change in reflectivity, and the MP process is halted.

In general, the endpoint detection apparatus and methods according to aspects of the present invention are applied to one or more workpieces to detect one or more endpoints on each workpiece. For example, a CMP endpoint detection process according to an aspect of the present invention might have several CMP endpoints to be detected for a single workpiece such as a wafer. The CMP endpoints can have respective polishing sequences and respective process conditions corresponding thereto. For example, removal of the metal overburden from the surface of the wafer might represent a first CMP endpoint, and removal of the barrier layer outside of the features of the wafer might represent a second CMP endpoint. A first threshold or level of signal intensity might be used to detect the first CMP endpoint so that when the signal intensity observed by the detection system drops to at or below the first threshold or level, the first CMP endpoint is determined to have been reached. Other thresholds or level of signal intensity might be used to detect other CMP endpoints. For example, for detecting a second CMP endpoint, when the signal intensity observed by the detection system drops to at or below a second threshold or level lower than that of the first threshold or level, the second CMP endpoint would be determined to have been reached.

It is to be understood that in the foregoing discussion and appended claims, the terms "workpiece surface" and "surface of the workpiece" include, but are not limited to, the surface of the workpiece prior to processing and the surface of any layer formed on the workpiece, including conductors, oxidized metals, oxides, spin-on glass, ceramics, etc.

B. Smart Endpoint Detection System

As will be described below, the invention provides an in-situ method of both thickness uniformity control and an endpoint detection for material removal processes such as CMP. In this system, the polishing member may be optically transparent, or partially transparent using elements such as windows or transparent sections.

Figure 5A:
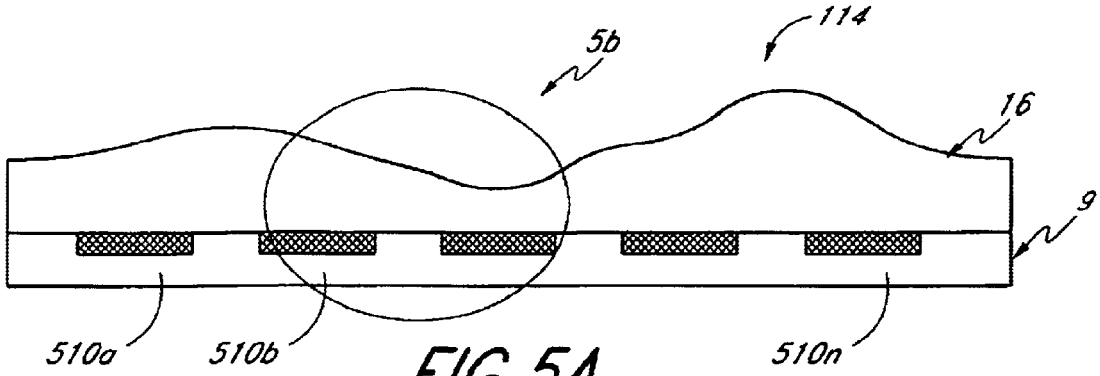
FIGS. 5A–C depict views of a workpiece surface.
Figure 5B:
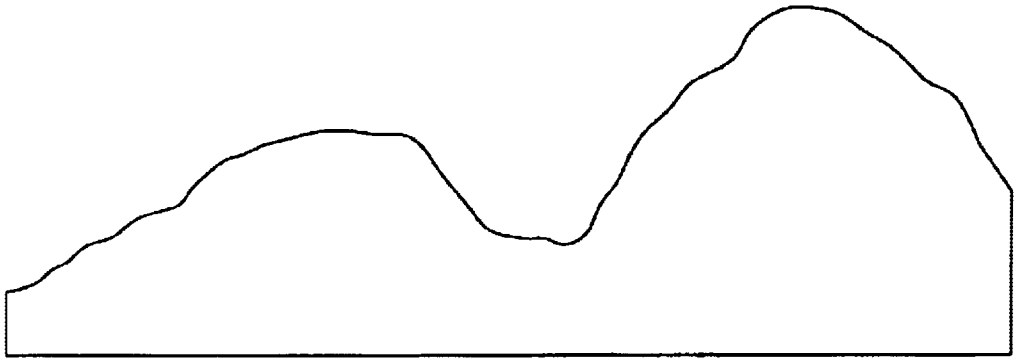
Figure 5C:
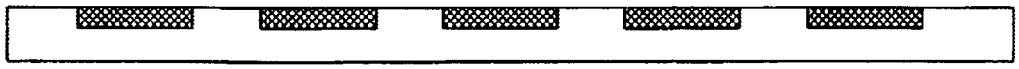

FIGS. 5A–C depict views of a workpiece surface. FIG. 5A depicts a wafer 9 after a film 16, e.g. copper, has been deposited thereover. The wafer includes a number of circuits formed in the wafer substrate 510*a*–510*n* that are shown for illustration, where n is arbitrary. Each of these circuits includes a large number of features that are filled with the deposited conductive film, often over a barrier layer. The CMP process removes the overburden and leaves the conductive film in these features. However, note that there is a global surface thickness variation that needs to be level when the overburden is removed using a process such as CMP. Since the surface varies, a process that simply polished away a predetermined thickness of the film 16 is likely to overpolish certain areas and underpolish others.

FIG. 5B depicts local surface variation on the wafer 114, which has been somewhat amplified for illustration. As mentioned above, since the surface varies, a process that simply polished away a predetermined thickness of the film 16 is likely to overpolish certain areas and underpolish others.

FIG. 5C depicts the wafer with the desired polishing endpoint where the conductive layer is in the features and the overburden is removed.

In one embodiment, the thickness uniformity detection and control system of the present invention maintains thickness uniformity of the processed surface using its real time thickness measuring capability and its control over the process parameters. Based on the derived real-time thickness data from the surface of the wafer that is processed, the thickness uniformity control system varies polishing parameters during a CMP process to uniformly polish a layer. As a result, end point of the polished layer is reached globally across the wafer surface without overpolishing and underpolishing of the subject layer. The polishing parameters may be changed by locally varying the pressure under the polishing member so that certain locations are polished faster than the other locations.

In one aspect of the invention, the invention maintains uniformity of the processed surface by using the detected real time endpoint data. Based on the derived real-time data from the surface of the wafer that is processed, the thickness uniformity control system varies polishing parameters during a CMP to uniformly polish a layer.

Although copper is used as an example material herein, the present invention may also be used in the removal of other materials, for example conductors such as Ni, Pd, Pt, Au, Pb, Sn, Ag, and their alloys, Ta, TaN, Ti and TiN, as well as insulators and semiconductors.

Figure 6A:
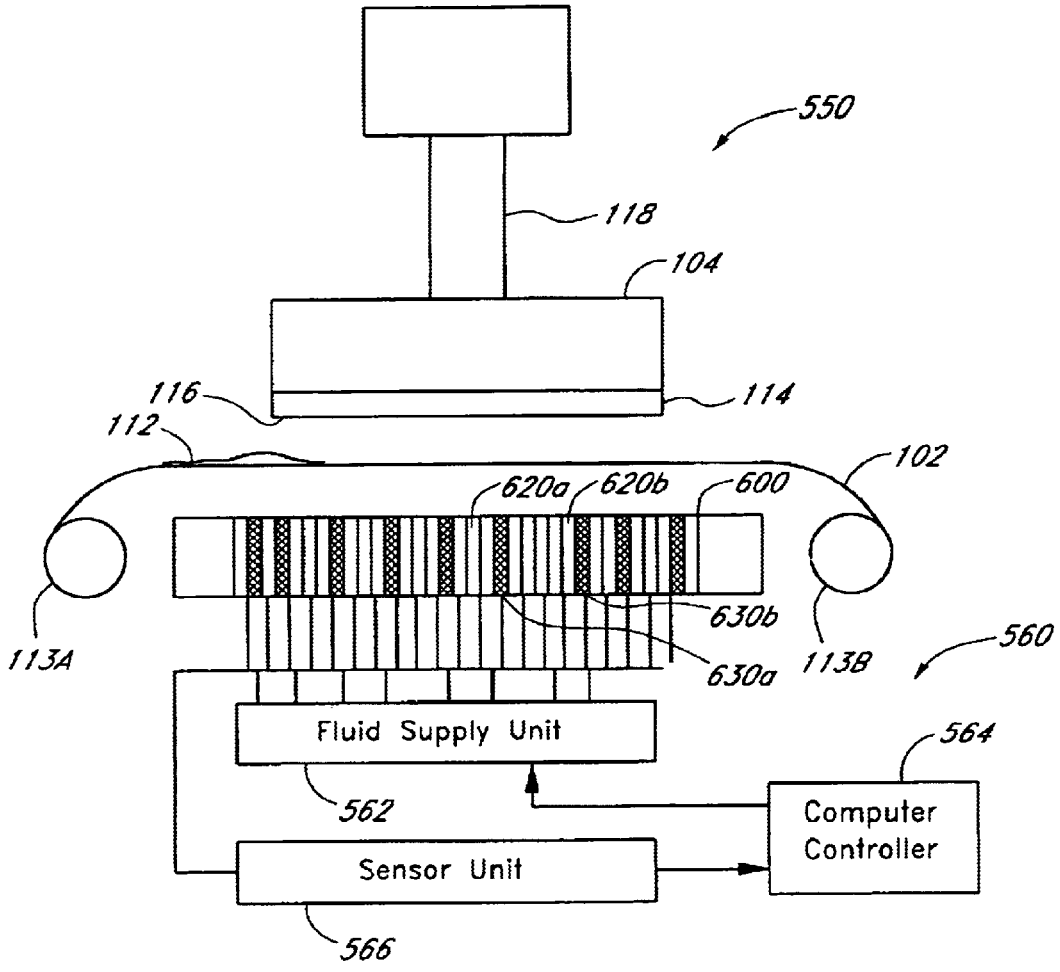
FIG. 6A depicts a workpiece processing system according to an embodiment of the invention.

FIG. 6A shows an exemplary chemical mechanical polishing (CMP) apparatus 550 with a thickness uniformity control unit 560. The CMP apparatus may further include an abrasive polishing member 102 and a carrier head 104. The polishing member 102 includes an upper or process surface 106 and a lower surface 108. The lower surface 108 of the polishing member is placed and tensioned on a support plate 600 such as a platen. The polishing member preferably comprises a composite structure having a top transparent abrasive layer formed on a transparent backing material. An abrasive layer contacts the workpiece during the process and includes fine abrasive particles distributed in a transparent binder matrix. An exemplary linear polishing member structure used with the present invention may include a thin coating of transparent abrasive layer, for example 5 $\mu$m to 100 $\mu$m thick, stacked on a transparent Mylar backing, which material is available from Mipox, Inc., Hayward, Calif. The abrasive layer may be 5 $\mu$m to 100 $\mu$m thick while the backing layer may be 0.5 to 2 millimeter thick. Size of the abrasive particles in the abrasive layer are in the range of approximately 0.2–0.5 $\mu$m.

Figure 6B:
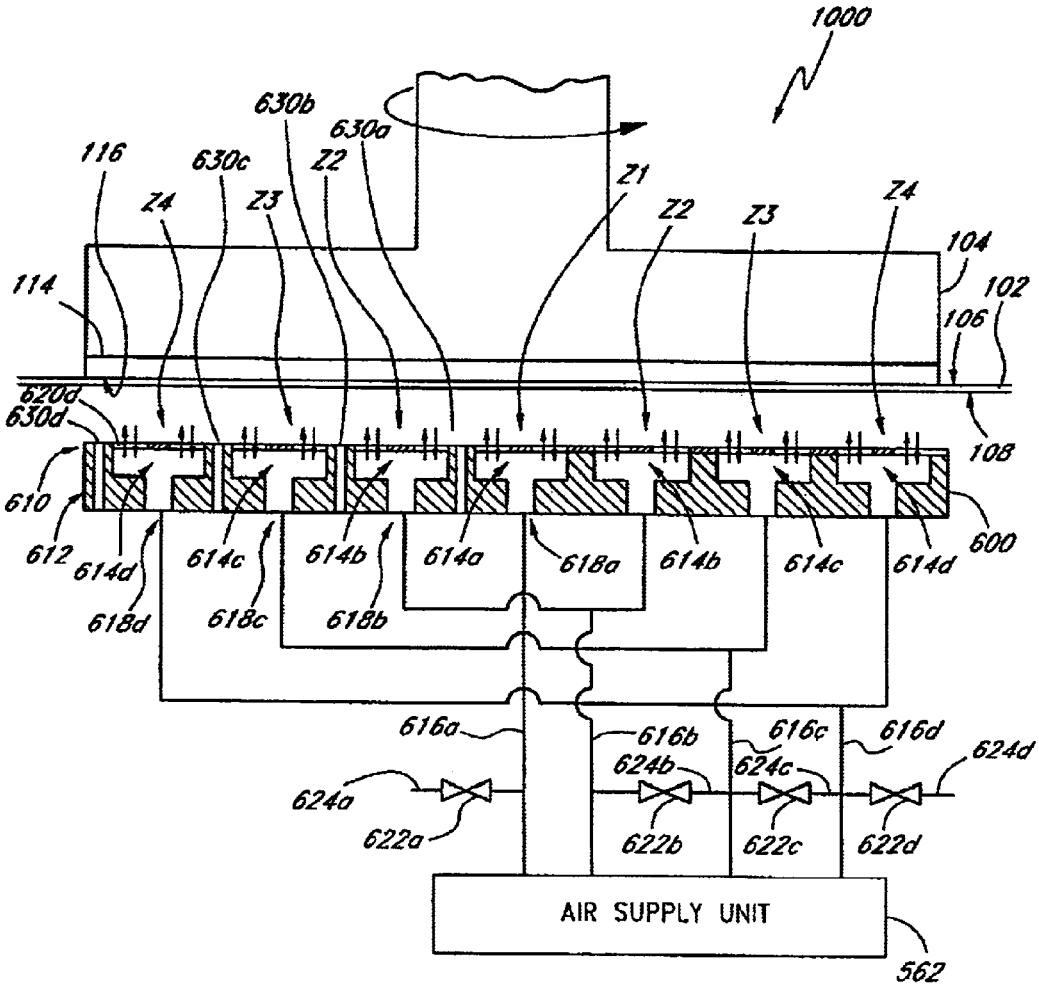
FIG. 6B depicts a workpiece processing system according to another embodiment of the invention.

The platen includes a plurality of holes 620*a*–620*n* which are shown in more detail in FIG. 6B (Also see FIGS. 7A–7B) for generating a fluid pressure under the polishing member during the process. The polishing member 102 may be replaced with non-abrasive polishing member, if a CMP slurry or polishing solution including abrasives is used. The holes 620*a*–620*n* are connected to a fluid supplied by fluid supply unit 562. In this embodiment, the polishing member 102 is an optically transparent polishing member, but can also be a polishing member that had windows therein or is composed of portions that are optically transparent.

The polishing member is selected to have sufficient flexibility to conform to the applied pressure and communicate a related local pressure against the wafer surface. The exemplary embodiments use a flexible polymer polishing member that adequately transmits pressure to local areas. If the polishing member is insufficiently flexible, e.g. reinforced with a steel belt, the pressure will be communicated over a large area and the system may continue to polish undesired areas of the wafer.

A polishing solution 112 is flowed on the process surface 106 of the polishing member 102, and the polishing member is moved over a set of rollers 113 either in unidirectional or bi-directional manner by a moving mechanism (not shown). In this embodiment, the polishing member is preferably moved bi-directional manner. The polishing solution 112 may be a copper polishing solution or an abrasive polishing slurry. The solution 112 may be fed from one or both sides of the wafer onto the polishing member, or it may also be fed onto the wafer surface through the polishing member, or both. A wafer 114 to be processed is held by the carrier head 104 so that a front surface 116 of the wafer, which will be referred to as surface hereinafter, is fully exposed. The head 104 may move the wafer vertically up and down as well as rotate the wafer 114 through a shaft 118. The surface 116 of the wafer 114 may initially have the structure shown in FIG. 5A with a copper layer 16 (that includes both the seed layer and the deposited copper) that can be polished down to an endpoint (as shown FIG. 5C), while the below thickness uniformity detection and control process of the present invention is in-situ performed. At this point, process may also be continued with a barrier layer removal step so that the barrier layer on top surface 15 of the insulation layer is polished away until the insulation layer 14 is exposed or the Barrier layer endpoint reached. In this example, the overburden layer is copper (Cu), the barrier layer 18 is tantalum (Ta) and the insulation layer 14 is silicon dioxide ($SiO_2$).

Figure 7A:
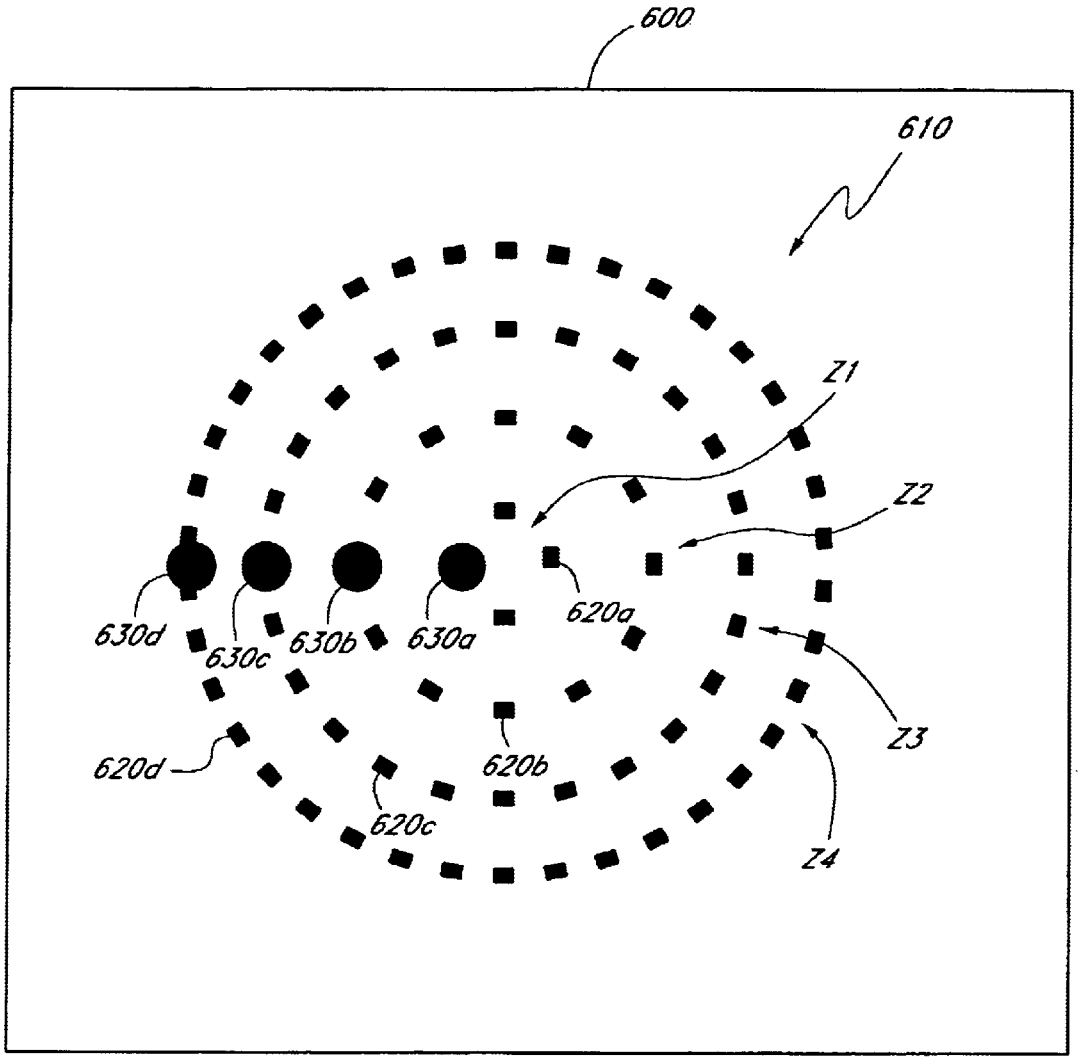
FIGS. 7A–B depict the platen of FIGS. 6A–6B according to an embodiment of the invention.
Figure 7B:
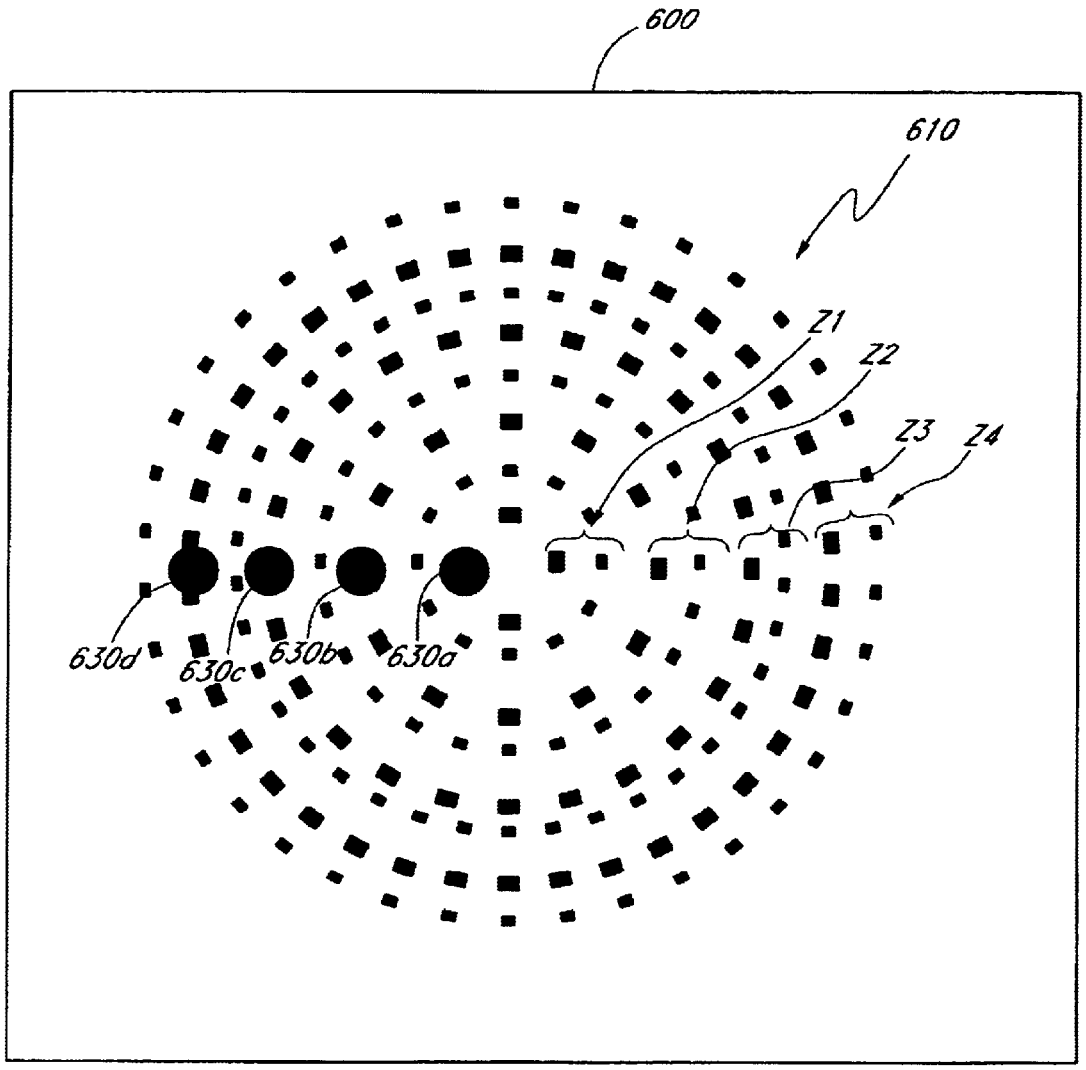

The uniformity control unit includes a fluid supply unit 562 for delivering the fluid (e.g. air) to the platen 600. The uniformity control unit also includes a computer controller 564 with a CPU, memory, monitor, keyboard and other common elements. The computer 564 is coupled to a series of exemplary sensors 630*a*–630*n*, where n is an arbitrary sensor identifier (630*a*–630*d* are also shown in FIGS. 6B and 7A–7B) through a sensor controller 566. The sensors 630*a*–630*n* are disposed in the platen adjacent to fluid holes 620*a*–620*n* in the platen. In this embodiment, holes of the platen are preferably grouped in certain manner, for example distributing each group of holes in a circular manner (see FIGS. 6B, 7A–7B). The exemplary sensors may comprise thickness sensors and endpoint detection sensors. As will be described below, each group of holes (known as pressurezones) are connected to the fluid supply unit that delivers fluid pressure controlled by computer controller 564. The fluid supply unit is capable of varying the fluid pressure (as fluid flow) for each pressure zone independently of one another.

In one aspect of the invention, the sensors 630*a*–630*n* are endpoint sensors comprising an optical emitter and detector placed under the polishing member. The endpoint sensor detects the polishing endpoint, when for example the copper layer is polished down to the barrier layer 18 on the top surface 15 of the insulation layer (see FIGS. 1A–1B).

As explained above, the present invention uses the ability to control local pressure from the different zones of the platen to increase or decrease the local polishing rate on the wafer. Accordingly, one key aspect of the invention is the ability to provide different polishing rates by employing different pressure zones on the platen. Polishing sensitivity of this system is improved by tightly controlling fluid or air pressure levels on each individual pressure zone. Establishing precisely controlled pressure levels for the pressure zones, in turn, results in greater control of local polishing rates on the wafer.

As shown in FIG. 6B, in the preferred embodiment, such discrete pressure zones having predetermined pressure levels may also be achieved by removal of the excess air from the top of the plate. As will be described more fully below, by allowing controlled leaks to the atmosphere or a vacuum source, present invention regulates the blown excess air that would flow over neighboring pressure zones, i.e., regulating cross-talk between the neighboring zones, and cause changes in air pressure level in the neighboring zones. FIG. 6B shows the exemplary system 550 with air leak valves. In this embodiment computer controller and sensor unit are not shown for the purpose of clarity. The system is mainly comprised of platen 600, wafer carrier 104 to hold the wafer 114 to process, and polishing member 102. As described above, the polishing member 102 has top surface 106 or a process surface and back surface 108. Front surface 116 of the wafer 114 faces to the top surface of the polishing member 102. Specifics of the polishing member and the polishing solutions are exemplified above, and therefore, for clarity, their description will not be repeated herein.

In comparison to FIG. 6A, FIG. 6B shows the platen 600 in more detail. As shown in FIG. 6B, the platen 600 may have an upper surface 610 enclosing a base block 612. The upper surface is divided into concentric pressure zones, namely first zone z1, second zone z2, thirds zone z3 and fourth zone z4. Such concentric zones are also exemplified in FIGS. 7A–7B. Zones z1–z4 include holes 620*a*–620*n*. As shown in FIG. 6B, each zone may comprise two or more holes. For example, the first zone z1 includes holes 620*a* and so on. Sensors 630*a*–630*n* are also placed in each zone. For clarity FIG. 6B does not include computer controller and sensor unit and connections to this unit (see FIG. 6A). Further, each zone in the surface 610 corresponds to an air chamber 614*a*–614*d* as in the manner shown in FIG. 6B. For example holes 620*a* in the first zone z1 is fed by the air flowing through the chamber 614*a*, the holes 614*b* in the second zone z2 is fed by air flow from the chamber 614*b* and so on. Chambers 614*a*–614*d* are formed as circular concentric grooves which are connected to an air supply unit 562 via air lines 616*a*–616*d* respectively. Each air line 616*a*–616*d* is connected to the corresponding chamber through one or more air ports 618*a*–618*d*. Further, by employing connectors, for example T-connectors, each air line 616*a*–616*d* is coupled to pressure control devices 622*a*–622*d* respectively. In this embodiment, pressure control devices are air valves 622*a*–622*d* connected to air lines 616*a*–616*d*. In this respect, each valve is associated with one of the pressure zones, for example, the first valve 622 is for the first zone z1, and the second valve 622B is for the second zone z2 and so on.

The valves 622*a*–622*d* include ventilation ports 624*a*–624*d*. The ventilation ports 624*a*–624*d* may be connected to out side atmosphere or vacuum (not shown) for removal of the vented air from the system 1000. In this embodiment, through the valves, it is possible to adjust amount of the air that may be vented out from the ventilation ports 624*a*–624*d* and thereby adjust the positive pressure on a pressure zone. When the valves 622*a*–622*d* are switched on, they vent out a percentage of the air that is flowing through the lines 616*a*–616*d*. In this respect, valves 616*a*–616*d* can be used create a positive pressure or a negative pressure or zero pressure in the zones. With a vacuum connection, a negative pressure or a zero pressure can be created on the pressure zone.

However, the most important function of a valve is to vent out air to adjust pressure level in a pressure zone that the valve is associated with, when excess air from neighboring zones flows over the zone and cause air pressure increase on that zone. In this embodiment, the air supply unit is capable of supplying same air flow rate to each pressure zone as well as varying flow rates to individual pressure zones to establish an air zone, having a predetermined air pressure profile, under the polishing member 102.

FIGS. 7A–7B show the surface 610 in plan view with zones z1–z4 including the holes 620*a*–620*n* and the sensors 630*a*–630*n*. In this embodiment, the exemplary sensors 630*a*–630*n* may be optical endpoint sensors, preferably comprising an optical emitter and detector, and are disposed in the platen under the polishing member from the workpiece. For example, sensors 630*a*–630*n* may be located in or near the zones z1–z4 which represents a pressure zone where the fluid pressure is selectively controlled by the fluid supply unit 562. Although in this embodiment exemplary optical sensors, which are located in the platen, are used, any type of sensors that are located in any suitable position in the system can be used and is within the scope of the present invention. As shown in FIG. 7B, each zone may comprise a plurality of concentric circles, and it is further anticipated that in some cases a zone may not have a sensor. The sensor unit 566 receives the raw sensor signals (e.g. reflected light) and creates electrical sensor signals that are sent to the computer 564 (see FIG. 6A), which controls the fluid supply unit 562 in the manner described above.

Figure 8:
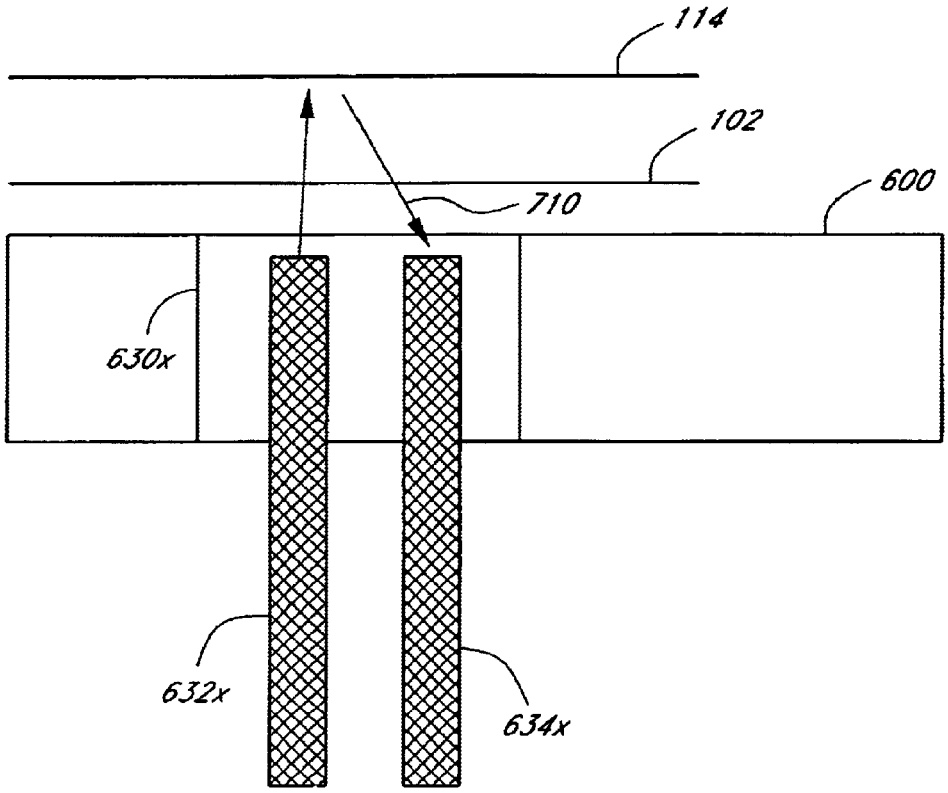
FIG. 8 is an exploded view of a sensor according to an embodiment of the invention.

The endpoint sensors of the invention can be any optical monitoring device that is used to monitor changes in reflectivity of the polished layer. Referring to FIG. 8, each sensor 630*x* includes a send fiber 632*x* that provides a light that is reflected off the workpiece 114 (see reference number 710) and a receive fiber 634*x* that receives the reflected light. The endpoint sensor detects the polishing endpoint by the change in reflected light, when for example the copper layer is polished down to the barrier layer 18 on the top surface 15 of the insulation layer (see FIGS. 1A–1B). In this aspect, the outgoing and the incoming signals travels through the optically transparent polishing member 102. Use of such sensors in CMP endpoint detection is disclosed in U.S. application Ser. No. 10/052,475, filed Jan. 17, 2002.

CMP is a process that polishes away a surface based roughly on the equation:

Polishing Rate=Constant×Velocity×Pressure.

The invention uses the ability to control local pressure to increase or decrease the local polishing rate. Consequently, one key aspect of the invention is the ability to employ different polish rates in different pressure zones.

Figure 9B:
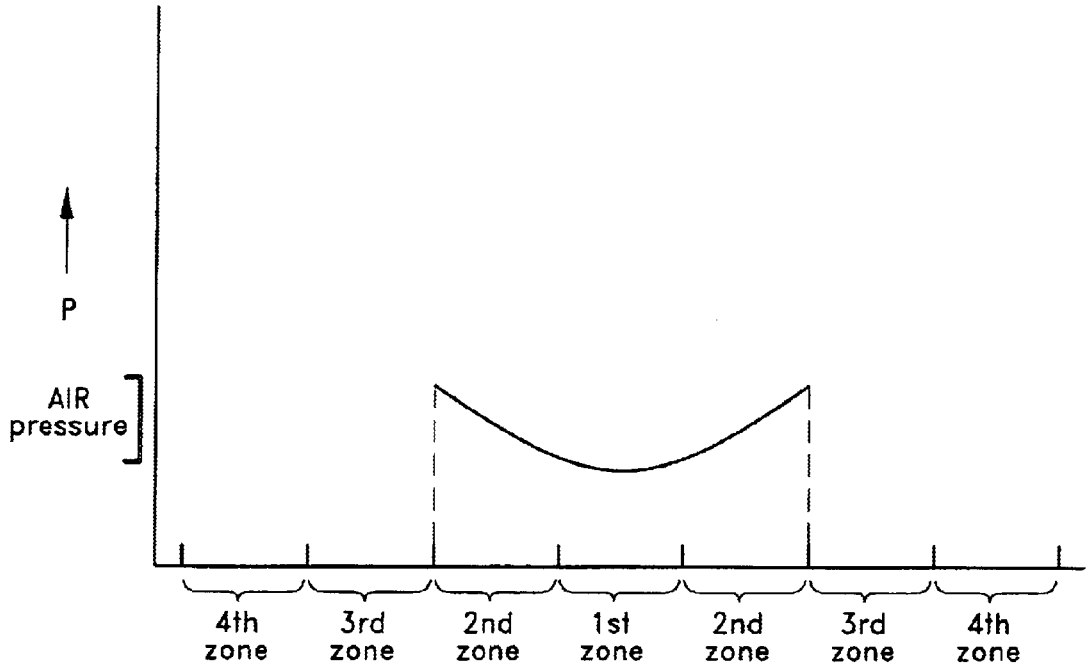
FIGS. 9A–B depict pressure profiles obtained with process of the present invention.
Figure 9A:
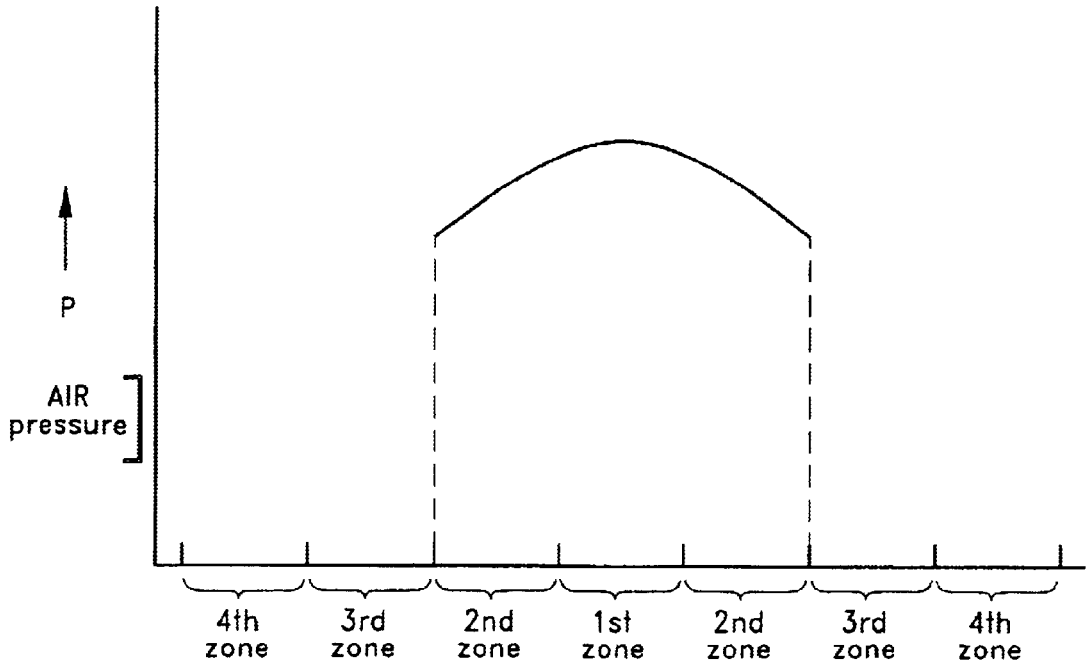

One operation sequence may be exemplified using pressure zones z1 and z2 to establish pressure profile shown in FIG. 9A. It is understood that use of two zones is for the purpose of exemplification. A pressure profile similar to the one in FIG. 9A can be formed using the pressure zones z1, z2, z3 and z4. The pressure profile shown in FIG. 9A can be established by having a high air pressure P1 in the first zone z1 but a lower air pressure in the surrounding second zone z2. In operation, this may be for example performed by first establishing pressure P1 in the fist zone z1 with a first predetermined amount of air flow to the first zone z1 from the air supply unit. During the establishment of pressure P1, the first valve 622*a* may be either adjusted to vent a fraction of the first air flow from the first line 616*a*. Establishment of pressure P2 in the second zone z2 may for example be done by flowing the first predetermined amount of air flow through the second air line 616*b* while lowering the pressure to P2 by venting a portion of the first predetermined air flow through the venting port 624*b*. At this point any air flow from the first zone to the second zone may increase the pressure in the second zone to a P3 pressure. In accordance with the present invention, the increase in pressure level in the second zone z2 is reversed by venting more air from the first predetermined flow via the second valve. As a result of venting, a reduction in the amount of first flow that is directed to the second zone occurs and the pressure level in the second zone z2 recovers back to P2 pressure level. The same process may be performed using different air flows for each zones. In this case, the pressure levels are again adjusted by venting predetermined amounts of the air flows.

Another operation sequence may be exemplified using also zones z1 and z2 to establish pressure profile shown in FIG. 9B. A pressure profile similar to the one in FIG. 9B can be formed using the pressure zones z1, z2, z3 and z4. The pressure profile shown in FIG. 9B can be established by having a low air pressure P1 in the first zone z1 but a higher air pressure P2 in the surrounding second zone z2. In operation, this may be for example performed by first establishing pressure P2 in the second zone z2 with a first predetermined amount of air flow to the second zone z2 from the air supply unit 562. During the establishment of pressure P2, the second valve 622*b* may be either switched off or switched on to vent a fraction of the first air flow. Establishment of pressure P1 in the first zone z1 may for example be done by flowing the first predetermined amount of air flow through the first air line 616*a* while lowering the pressure to P1 level by venting a predetermined portion of the first predetermined air flow through the venting port 624*a*. At this point any air flow from the second zone z2 to the first zone z1 may increase the pressure in the first zone z1 to a P3 pressure. As in the previous case, the increase in pressure level in the first zone z1 is reversed by venting more air from the first predetermined flow via the first valve 622*a*. As a result of venting, a reduction in the amount of first flow that is directed to the first zone z1 occurs and the pressure level in the first zone recovers back to P1 pressure level. The same process may be performed using different air flows for each zones. In this case, the pressure levels are again adjusted by venting predetermined amounts of the air flows. These processes described in connection with FIGS. 9A–9B may also be controlled dynamically. For example, valves may be controlled or regulated with inputs from the pressure sensors placed within each pressure zones z1–z4 shown in FIG. 6B. When the pressure in one zone, due to air flow from the neighboring zones, increases, the valve vents predetermined amount of air to adjust air pressure on that zone. Ventilation through the valves can be controlled by a controller that receives pressure input from the sensors.

Figure 10A:
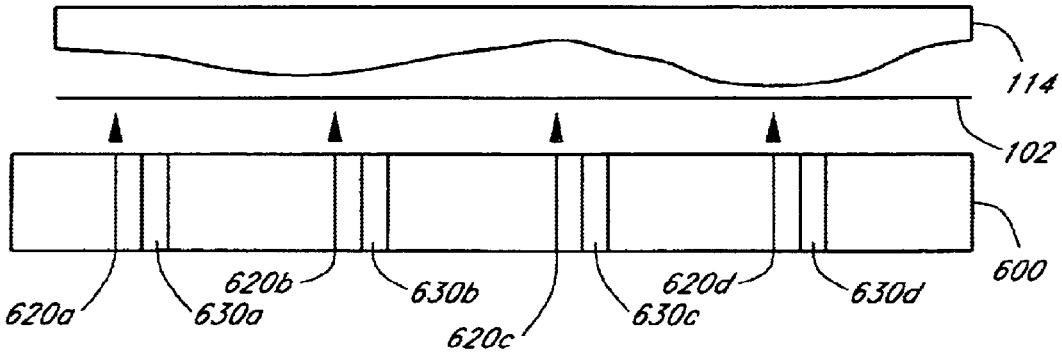
FIGS. 10A–C depict polishing a workpiece according to an embodiment of the invention.
Figure 10B:
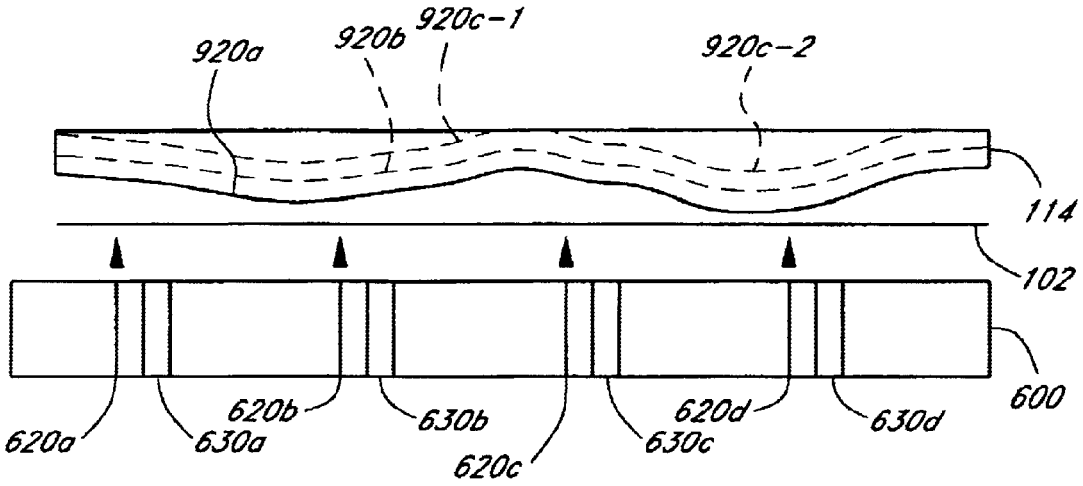
Figure 10C:
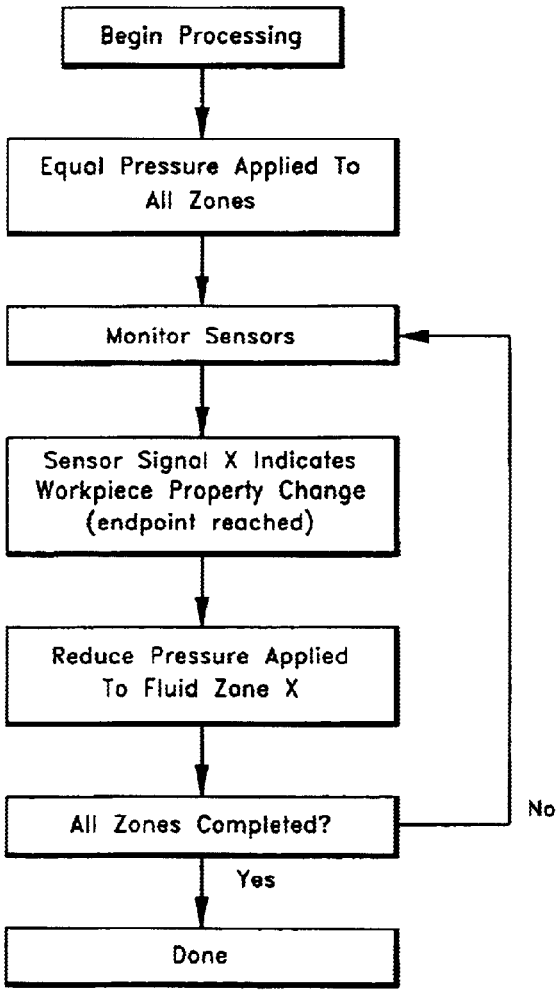

When operating on a copper layer with a barrier layer beneath, as soon as the barrier layer is exposed, the signal from the endpoint sensor changes as a result of change in reflectivity. Referring to FIGS. 10A–10C, in the exemplary process, one area of the wafer may need more polishing than another area, or one area may thin down faster than another area and thus the copper endpoint may be reached for one area faster than for another area. As soon as the copper endpoint is detected by the endpoint sensors, the air pressure in that pressure zone is reduced to slow down or eliminate further polishing in that area. Alternately, the air pressure may be increased in other areas that have not yet reached endpoint. With the difference in removal rate, the copper at the finished area is not substantially removed any longer and the other areas can continue to be polished. The aspect of the invention here is the difference of air pressure applied to pressure zones based on their status regarding endpoint.

FIGS. 10B–10C depict an example of smart endpoint detection. As shown in FIG. 10B, the workpiece surface is defined by reference 920*a*. After some polishing time, the surface is reduced to reference 920*b* and the layer is very thin near the zone close to sensor 630*c*. After more polishing time, when the surface is polished down to reference 920*c* (920*c*-1 and 930*c*-2), sensor 630*c* will detect a change in the surface and controller 560 will reduce the pressure (fluid flow rate) to that zone. Consequently, that zone will experience less polishing, while the other zones continue to be polished at the original rate. Of course, it is also anticipated that the fluid flow could be increased to certain unfinished zones, if so desired. Once all the zones are polished (all the sensors report the endpoint is reached), then the process is completed.

Although various preferred embodiments have been described in detail above, those skilled in the art will readily appreciate that many modifications of the exemplary embodiment are possible without materially departing from the novel teachings and advantages of this invention.

C. Variations of the Embodiments

In one aspect of the invention, acoustic sensors can be used in place of the optical sensors described above. In this aspect, the sensors 630*a*–630*n* detect the thickness of the polished layer in real-time, while the wafer is processed, and supply this information to the computer through the sensor unit 566. The computer 564 then evaluates the supplied thickness data and, if non-planarity in the removed layer is detected, selectively readjusts the material removal rates by varying one or more polishing parameters, such as air pressure under the polishing member or slurry compositions, on the wafer to obtain thickness uniformity across the wafer surface.

Figure 11:
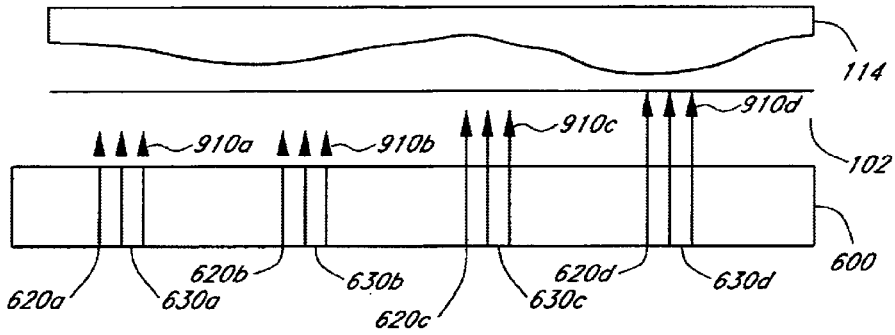
FIG. 11 depicts polishing a workpiece according to an embodiment of the invention showing different force vectors depending on the workpiece profile.

In another aspect of the invention, FIG. 11 depicts polishing a workpiece showing different pressure vectors 910*a* to 910*d* depending on the workpiece profile. The longer arrows represent a greater force. If a workpiece zone needs more polishing, then computer controller instructs the fluid supply unit to provide increased pressure on that zone. Likewise, when a zone does not need additional polishing, then computer controller instructs the fluid supply unit to provide less pressure on that zone.

In another aspect of the invention, a heat exchanger is coupled in-line with the fluid supply to the platen so that the temperature of the fluid delivered to the platen is controlled and can be maintained at a preset temperature. The platen can further include a temperature sensor in order to provide feedback to the heat exchanger in order to maintain a predetermined temperature of the polishing member.

D. Platen With Buffer Layer

During a CMP process using a polishing member as described above, several factors may damage either the polishing member, the wafer surface, or both. In terms of wafer surface, any un-parellelism while making contact between the workpiece surface to be polished and the polishing member surface may damage the workpiece surface. Before any CMP process, the platen surface and the workpiece surface to be polished should be aligned so that they are substantially parallel. Any significant deviation from this parallelism may bring a portion of the workpiece closer to the platen surface while placing another portion of the workpiece surface away from the platen surface. Such surface portion, or so called high spot on the workpiece, that is closer to platen surface may be over polished or hit the platen surface, resulting in damages to the workpiece surface and also to the polishing member. Such misalignment, i.e., un-parallelism, between the platen and workpiece surface is particularly damaging during the polishing of low-k material containing substrates. Due to the fragile structure of the low-k dielectric materials, any collision with the platen occurring during the polishing of low-k substrates may entirely damage the low-k material structures.

In terms of the polishing member, any large particle trapped between the fixed abrasive polishing member and the platen may scratch or damage the thin fixed abrasive polishing member. Furthermore, the endpoint windows should be smoothly aligned with the platen surface. Any significantly misaligned window ends may form a bump on the surface of the platen and may scratch the polishing member or damage the workpiece.

Such problems can be avoided using a shock-absorbing medium in combination with the platen described herein. In one example, the shock-absorbing medium is a shock-absorbing buffer layer between the polishing member and the platen surface. The embodiments described herein can include any combination of platen, polishing member (with or without fixed abrasive) and polishing solution (with or without slurry).

Figure 12:
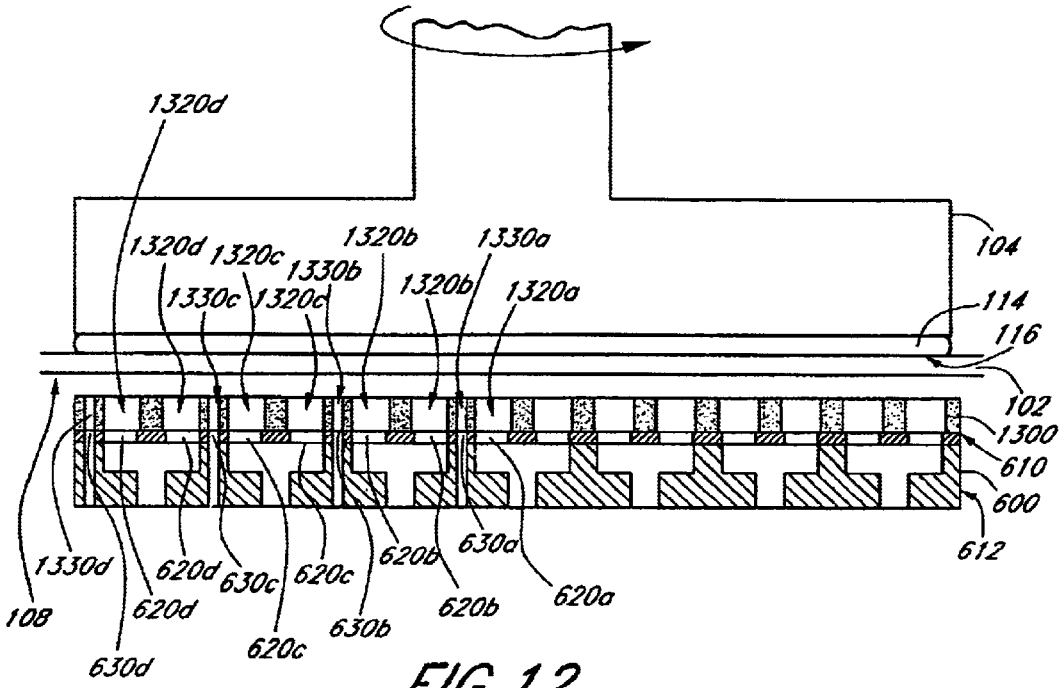
FIG. 12 depicts a platen having a shock absorbing buffer layer according to one embodiment of the present invention.

FIG. 12 shows the platen 600 with a shock-absorbing buffer layer 1300 attached on top of the platen surface 610. The buffer layer 1300 may be made of a soft polymeric material, such as polyurethane or any such material that may withstand chemical environment of the CMP process. The buffer layer 1300 may have first holes 1320*a*–1320*n* with the same pattern of the platen fluid holes 620*a*–620*n* and, second holes 1330*a*–1330*n* with the same pattern as the sensors 630*a*–630*n*. In this embodiment, the size of the holes 1320*a*–1320*n* may be larger than the size of the fluid holes 620*a*–620*n*. During the CMP process, the holes 1320*a*–1320*n* allow a fluid, such as air, to be injected under the polishing member 102 while the carrier head 104 holding the wafer 114 is lowered onto the polishing member. The polishing member is then preferably moved in a bidirectional linear motion over the platen, including the buffer layer. Of course, the polishing member can be moved in other directions, e.g., circular.

As the polishing member 102 is moved over the buffer layer 1300, fluid pressure through the holes 1320 is applied under the polishing member 102. The buffer layer allows fluid distribution through and over the platen, but provides additional safety to avoid accidental contact between the platen hard face, the polishing member and the wafer surface. The invention brings a particular advantage to the CMP process for fragile low k and ultra low k materials. The soft buffer layer absorbs any instantaneous shock to the wafer and minimizes the damage to low k materials.

In addition to the previous embodiment, the present embodiment provides an improved CMP process for low-k dielectric substrates. Although use of fixed abrasive polishing members may offer lower dishing and erosion in comparison to conventional polishing members, the hard surface on fixed abrasive polishing members may generate higher defects or local delamination when used on substrates having low-k dielectrics. As previously mentioned, the low-k dielectrics used in the copper metallization is generally very fragile and has poor adhesion. Controlling the coefficient of friction between the substrate and the polishing member is important to prevent low-k dielectric delamination during different steps of CMP. Technical challenges related to the overall strength of the low-k dielectrics in copper/low-k integration and CMP induced damage may be reduced or even eliminated using the process of the present invention.

Conventional techniques using fixed abrasive polishing material may use a polishing solution without slurry. However, in one process according to the invention, a copper layer of an exemplary substrate may be removed using a fixed abrasive polishing member while a polishing solution containing a predetermined amount of slurry is delivered onto the fixed abrasive polishing member. These added particles lubricate the polishing member surface and reduces the lateral forces on the polished substrate surface. Exemplary particles include, but are not limited to, alumina, ceria, silica, or any other metal oxides or polymeric resin beads. An exemplary concentration of the particles in the polishing solution may be from 0.1 to 40% by weight, more preferably from 0.5 to 5% by weight. An exemplary polishing solution may be prepared by adding alumina or silica particles to a copper polishing solution such as CPS-11 solution which is available from 3M.

E. Multi-Layer Polishing

In another embodiment, the copper and barrier layer removal may be performed in an integrated CMP tool, on separate polishing members used in separate CMP stations. In the first CMP station, in a first process sequence, the copper layer of the substrate is removed using fixed abrasive polishing and a polishing solution containing the particles. The polishing process may be performed using the shock absorbing buffer layer 1300 that is described in the previous embodiment in connection with FIG. 12. During the process, using a system similar to the one shown in FIG. 12, a wafer is lowered on to the fixed abrasive polishing member and a polishing solution containing lubricating particles is delivered onto the polishing member. As described above, the fixed abrasive polishing member is moved over the buffer layer 1300 while a fluid pressure is applied under the polishing member. Once the copper layer is removed down to the barrier layer on the surface of the low-k dielectric (see FIG. 1B), a barrier layer removal process is performed in a second CMP station. In this step, a CMP station shown in FIG. 12 may be used with a polymetric/non-fixed abrasive polishing member. The polishing member may be made of a soft polymeric material such as polyurethane. In this example, during the barrier removal, a selective polishing solution is delivered onto the polymetric polishing member suitable for barrier material removal while the polishing member is moved and a fluid pressure applied under the polishing member as described above. This sequence of process steps minimizes the stress on low-k dielectric and resulting delamination as well as minimizes dishing and scratches.

In another embodiment, the copper and barrier layer removal may be performed in the same CMP station. The first step is performed for copper removal before the barrier layer removal. According to this process sequence, in a first step, bulk copper may be removed down to barrier layer on the fixed abrasive polishing member. At this step the polishing solution may or may not contain particles. In a second step, combination of the fixed abrasive polishing member and the polishing solution with particles is used to remove the remaining copper layer from the surface of the barrier layer while applying a down force on the workpiece, which for example, could be a relatively low down force. Following these steps, in another CMP station, a barrier layer removal step is performed on a soft polymeric polishing member while delivering a Ta selective polishing solution onto the polishing member and while applying a low down force on the work piece.

F. Carrier Head Pressure Variation

Figure 13A:
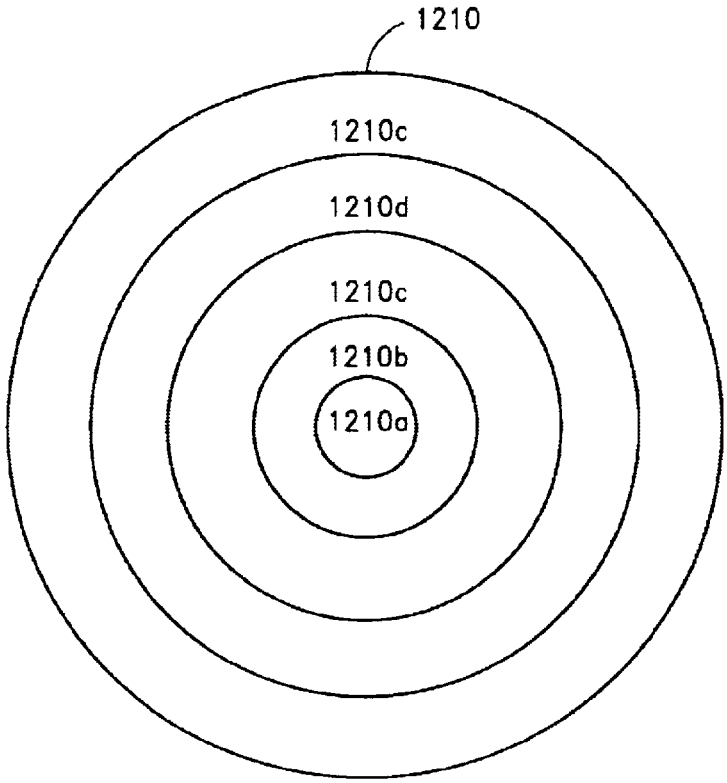
FIGS. 13A–B depict an embodiment for varying the pressure profile by applying pressure from behind a workpiece.
Figure 13B:
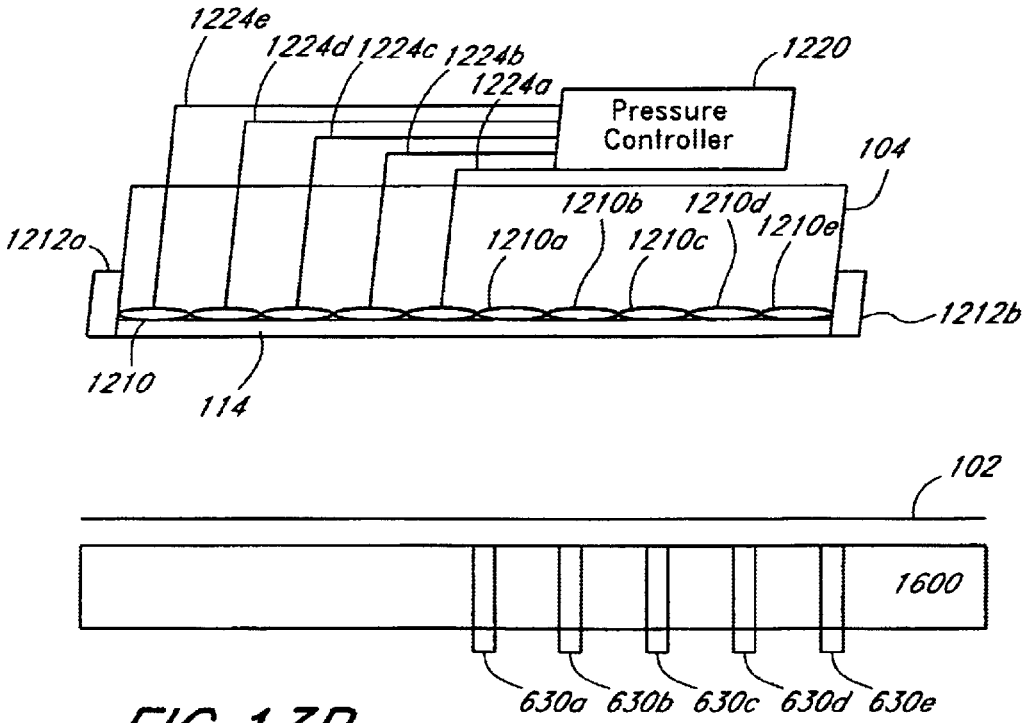

FIGS. 13A–B depict an embodiment for varying the pressure profile by applying pressure from behind the wafer 114. In this embodiment, the pressure gradient is applied to the wafer 114 using the head 104 while holding the wafer in place. A flexible or inflatable membrane 1210 corresponds in shape to the carrier head, which is typically circular in shape, and is attached adjacent to the inner circumference of a raised surface area. The inflatable membrane 1210 provides a compliant wafer support during the processing. The inflatable membrane 1210 is constructed of a thin compliant material, such as an elastomer, preferably Viton®. The membrane is attached to the head 104 preferably using a combination of glue and fasteners or clamping mechanism. This attachment structure holds and seals the membrane 1210 in place when inflated.

While the exemplary embodiment describes an inflatable membrane, the membrane may alternately be constructed of a flexible, but not necessarily inflatable, compliant material. If the membrane is not inflatable, a spongy type material can be used to force the wafer against the polishing member.

Referring to FIG. 13A, the membrane 1210 is divided into a plurality of zones 1210*a*–1210*e*, where there may be any number of zones. A fluid is supplied into, and may also be exhausted from, these zones in order to apply a pressure gradient to the workpiece. As described below, the fluid from the fluid lines 1224*a*–1224*e* is used to inflate the inflatable membrane 1210 and maintain the inflation through the processing that takes place. During the processing, the pressure applied by the membrane is preferably within the range of 0.1 to 10 psi.

The wafer may be held in position in one of several ways while in process. One way is by using a retainer 1212*a*–1212*b*, as shown in FIG. 13B. Such a retainer 1212 preferably holds the wafer in a fixed position while not obstructing the surface for processing. Another technique for holding the wafer in place is by using a vacuum between the wafer and the membrane, similar to that described in U.S. Ser. No. 10/043,656, incorporated herein by reference. In operation, after placing the wafer 114 on the membrane 1210, a backing member is inflated until the lower layer contacts the membrane 1210. A head cavity is then evacuated to apply vacuum suction to the wafer 114. As the vacuum is applied to the cavity, connection regions or valleys between the pockets provide low pressure spaces and thereby cause the neighboring membrane portion to collapse into the valleys. This, in turn, generates a plurality of low pressure spaces on the back surface of the wafer 114. Such low pressure spaces act like suction cups and provide adequate suction power to retain the wafer during the processing.

The zones 1210*a*–1210*e* are connected to a pressure controller 1220 by separate pressure lines 1224*a*–1224*e* while polishing. These lines allow the pressure controller to create a variable pressure gradient at the back of the wafer so that the removal rate uniformity of the film that is already on the front surface of the wafer can be controlled by differing pressure behind the wafer during the processing. For example, exerting higher pressure to the center but less pressure to the periphery of the wafer significantly increases the mechanical component of the process at the center of the wafer in comparison to the mechanical component at the periphery of the wafer, increasing the material removal rate from the central region.

FIG. 13B also shows a platen 1600, which can be similar to the platen 600 described above, or may be a flat surface with the polishing member fixed onto. In such an aspect of the invention, relative motion between the wafer and the polishing member is obtained by moving the polishing member, the head or both. In any case, the substrate surface monitor sensors 630*a*–630*n* are mounted in the platen and monitor the wafer either through the polishing member or through an opening in the polishing member. The sensors in platen 1600 are connected to a sensor unit 566 and computer controller 564 similar to that shown in FIG. 6A. The computer controller controls the pressure controller 1220 and provides feedback to the processing system in order to control pressure applied to each zone on the workpiece and optimally process the workpiece. As explained above with reference to flowchart FIG. 10C, this method may be employed to selectively endpoint at different regions of the workpiece at different times.

G. Sensing Apparatus with Color Sensor

Figure 1C:
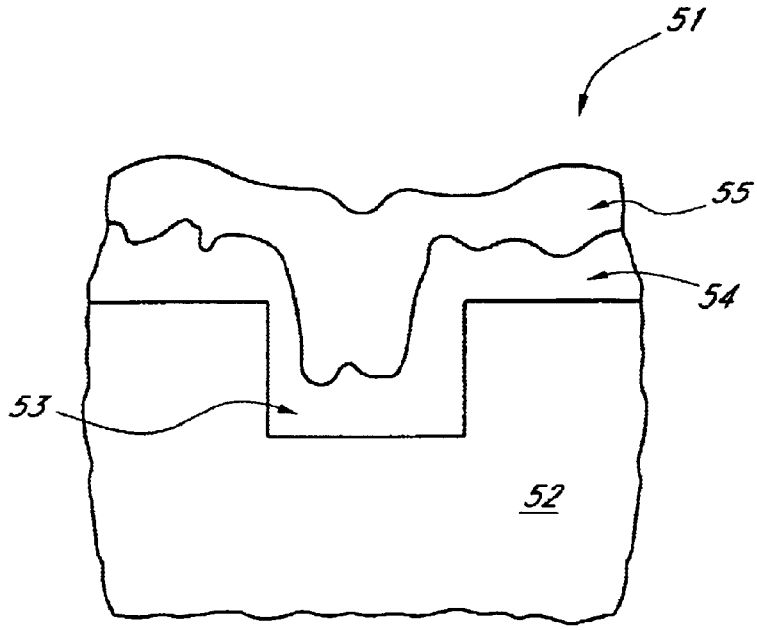
FIG. 1C is a diagram illustrating a cross-sectional view of an exemplary substrate following deposition of insulating material onto the surface of the substrate.
Figure 1D:
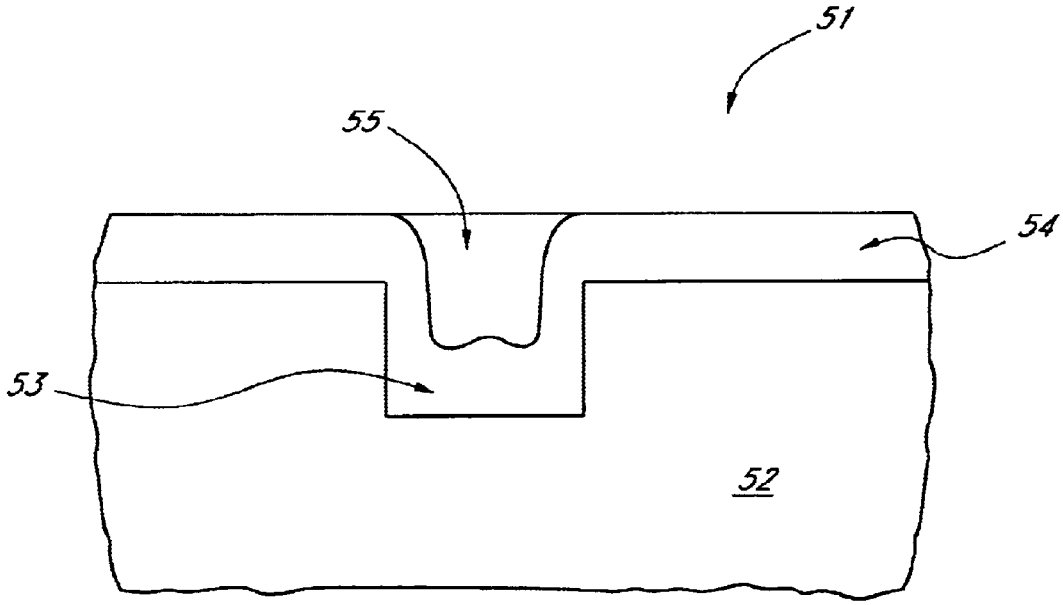
FIG. 1D is a diagram illustrating a cross-sectional view of the exemplary substrate of FIG. 1C following a conventional CMP process.
Figure 14:
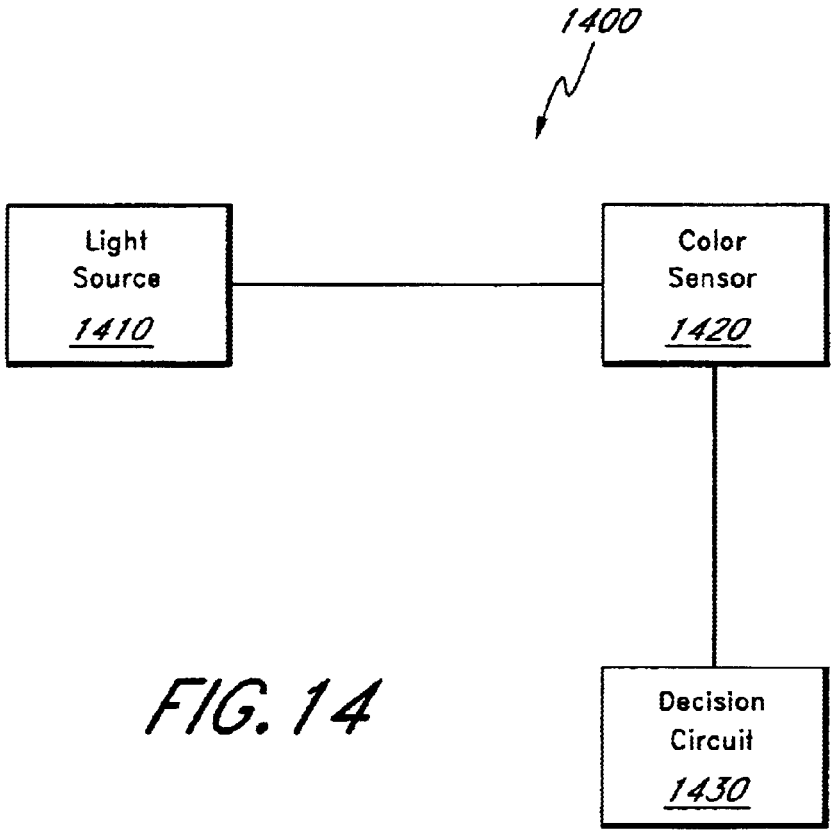
FIG. 14 depicts an embodiment of a color sensing apparatus for detecting a processing endpoint of a multi-layer semiconductor wafer, where the color sensing apparatus includes a light source, a color sensor, and a decision circuit.

In one embodiment, a sensor used for endpoint detection of a multi-layer wafer is a color sensor. In this context, the term "color" means at least one of differing qualities of light reflected or emitted from the surface. The reflected light has polychromatic attributes, e.g. a plurality of wavelengths. FIG. 14 depicts an exemplary embodiment of a color sensing apparatus 1400 for detecting a processing endpoint of a multi-layer semiconductor wafer, where the color sensing apparatus includes a light source 1410, a color sensor 1420, and a decision circuit 1430. As will be discussed further below, the color sensor may be a single wavelength sensor or a multiple wavelength sensor (multi-wavelength sensor). The color sensing apparatus may be used, for example, in connection with a shallow trench isolation (STI) chemical mechanical polishing (CMP) procedure. A description of an exemplary STI CMP procedure is provided with reference to FIGS. 1C and 1D above.

In the exemplary embodiment, the light source emits incident light against a surface of the semiconductor wafer. The color sensor is optically coupled to the light source and senses reflected light, which is called a reflection color, from the surface of the semiconductor wafer in response to the incident light. In one aspect, the color sensor is a single wavelength sensor. The color sensor is configured to generate a sensor signal in response to the reflection color. The decision circuit is coupled to the color sensor and is configured to decide whether the wafer processing endpoint has been reached based at least in part on the sensor signal.

In one aspect of the invention, the light source and color sensor are located in close proximity to the wafer. In another aspect, the light source is coupled to an optical fiber. In this aspect, the light source includes the output end of the optical fiber. Similarly, the color sensor may be coupled to an optical fiber to sense the reflection color. In this aspect, the color sensor includes the optical fiber.

As stated above, instead of being a single wavelength sensor, the color sensor may be a multi-wavelength sensor. The light source may emit multi-spectrum incident light and the color sensor may sense a multi-spectrum reflection. Multi-spectrum means having at least two wavelengths. In one aspect of the invention, the color sensor is configured to sense light in the wavelength range spanning from 400–800 nm. In another aspect, the light source emits white incident light and the color sensor senses a red-green-blue (RGB) reflection.

The decision circuit is configured to decide whether the wafer processing endpoint has been reached based at least in part on the sensor signal. The decision circuit may include a comparator to compare the reflection color from the surface of the semiconductor wafer against a threshold reflection color. The threshold reflection color can be, for example, a reflection color from a sample semiconductor wafer that has reached its processing endpoint. In this aspect, the decision whether the processing endpoint has been reached is based upon reflection color comparison data from the comparator. The reflection color comparison data may be, for example, a comparison of reflection wavelengths. In another aspect of the invention, the decision circuit utilizes algorithms to determine whether the wafer processing endpoint has been reached.

The threshold reflection color may be initialized by sensing the reflection color of a known material. In one aspect, the threshold reflection color is based upon a reflection from a silicon dioxide ($SiO_2$) layer of a sample semiconductor wafer. In another aspect, the threshold reflection color is based upon a reflection from a silicon nitride ($Si_3N_4$) layer of a sample semiconductor wafer. In yet another aspect, an upper layer of the wafer is copper (Cu) and a lower layer is a barrier layer, such as tantalum (Ta) or tantalum nitride (TaN) or tantalum/tantalum nitride (Ta/TaN). In this aspect, the threshold reflection color may be based on a reflection from a sample semiconductor wafer that has been polished to the barrier layer. Alternatively, the threshold reflection color may be based upon a reflection from a copper layer of the sample semiconductor wafer. Again in the alternative, the threshold reflection color may be based upon a reflection from an insulator layer of the sample semiconductor wafer.

In a further aspect, one layer of the semiconductor wafer is hydrophilic and another layer is hydrophobic. (Hydrophilic means readily retaining water, while hydrophobic means not readily retaining water). For example, an upper layer of the wafer may be composed of silicon dioxide which is hydrophilic, while a lower layer of the wafer is silicon nitride, which is hydrophobic. Because the silicon dioxide layer is hydrophilic, a thin water film typically forms on its surface. However, when an STI CMP process polishes the wafer down to the silicon nitride layer, there is typically little or no moisture on the nitride surface. The absence of moisture on the silicon nitride surface allows for consistent measurement of the processing endpoint.

As stated above with reference to FIG. 14, the sensing apparatus may be used in connection with STI CMP. When a semiconductor wafer undergoing STI CMP is polished from the silicon dioxide layer 55 to a silicon nitride/silicon dioxide interface (referring to FIGS. 1C and 1D), the reflection color changes from greenish (usually 4–5 kA) to yellow or purple. In this example, the silicon nitride/silicon dioxide interface represents the processing endpoint. Therefore, referring again to FIG. 14, the color sensing apparatus can detect when an STI CMP process has successfully reached the processing endpoint by monitoring when the reflected color changes from greenish to yellow or purple. The preceding STI CMP technique is exemplary and other techniques are anticipated.

The color sensor may be tolerant to variations in sensing angle and sensing distance, i.e. the distance from the color sensor to the surface of the semiconductor wafer. In one aspect, the color sensor is positioned at a sensing distance that allows for an optimum optical signal to be sensed. For example, the sensing distance may be 2–10 mm.

The sensing apparatus may operate to perform endpoint detection on semiconductor wafers at a predefined frequency. For example, the sensing apparatus may test every $50^{th}$ wafer to determine the accuracy of a wafer polishing procedure.

Figure 15:
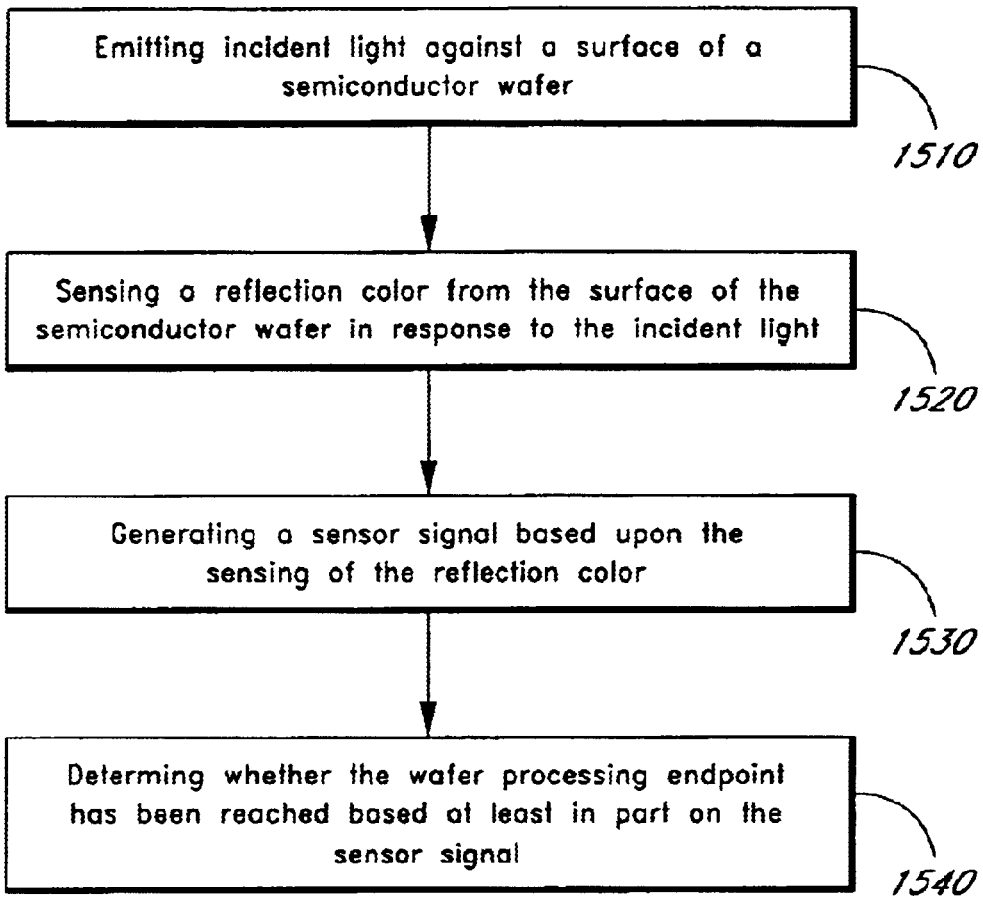
FIG. 15 is a flow diagram of an embodiment of a method for detecting a processing endpoint of a multi-layer semiconductor wafer.

FIG. 15 is a flow diagram of an embodiment of a method for detecting a processing endpoint of a multi-layer semiconductor wafer, for example using the color sensing apparatus 1400. In step 1510, incident light is emitted against a surface of a semiconductor wafer. In step 1520, a reflection color is sensed from the surface of the semiconductor wafer in response to the incident light. In step 1530, a sensor signal is generated based upon the sensing of the reflection color. In step 1540, a determination is made of whether the wafer processing endpoint has been reached based at least in part on the sensor signal.

Use of the color sensor may reduce or eliminate problems associated with other types of photoelectric sensors, such as limited differentiation capability and inability to compensate for fluctuations in target distance. An exemplary color sensor that may be used with the present invention is available from Keyence, Inc., Woodcliff Lake, N.J.

H. Movable Structure for In-situ Endpoint Detection

To allow for in-situ endpoint detection, a sensing apparatus may be coupled to a movable structure. As a result of coupling the sensing apparatus to a movable structure, endpoint detection may be performed on a semiconductor wafer without removing the semiconductor wafer from its processing mount, i.e. carrier head 104 (with reference to FIG. 2). In one embodiment, an endpoint detection system includes a sensing apparatus configured to sense a metric related to a surface of a semiconductor wafer and to generate a sensor signal based upon the metric. The system also includes a decision circuit coupled to the sensing apparatus and configured to decide whether the wafer processing endpoint has been reached based at least in part on the sensor signal. The system further includes a movable structure coupled to the sensing apparatus to position the sensing apparatus to sense the metric.

The sensing apparatus may include, for example, the light source 1410 and the color sensor 1420 described above with reference to FIG. 14. In this aspect, the light source and the color sensor are coupled to the movable structure to sense the reflection color from the surface of the semiconductor wafer. In another aspect, the light source and the color sensor are coupled to the movable structure to scan the surface of the semiconductor wafer. In yet another aspect, the movable structure positions the color sensor to sense the reflection color. The sensing apparatus may also include the decision circuit 1430. Alternatively, the sensing apparatus may be a different kind of sensing apparatus from the sensing apparatus 1400 described above with reference to FIG. 14.

Figure 16A:
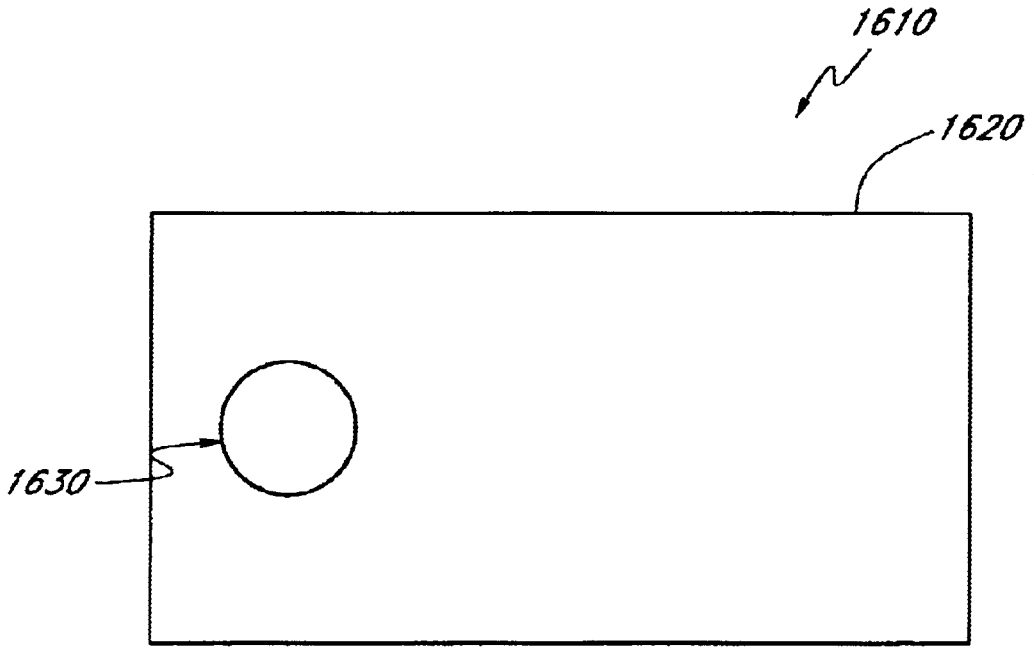
FIG. 16A depicts a top view of an embodiment of an endpoint detection apparatus used for in-situ endpoint detection that includes a movable structure and a sensing apparatus.
Figure 16B:
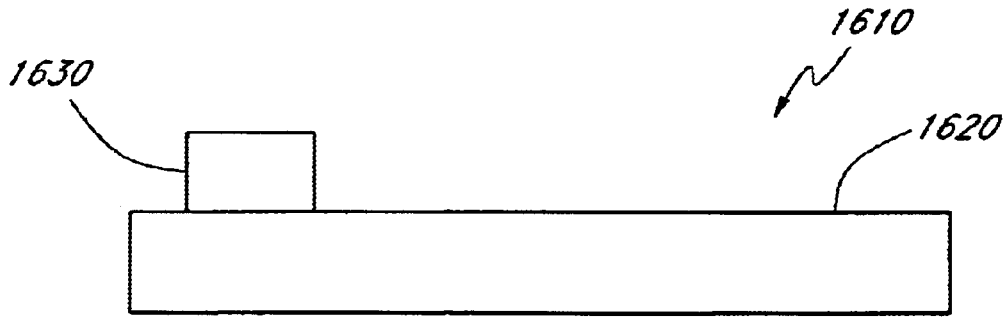
FIG. 16B depicts a side view of an embodiment of the endpoint detection apparatus of FIG. 16A used for in-situ endpoint detection that includes the movable structure and the sensing apparatus.

FIG. 16A depicts a top view of an embodiment of an endpoint detection apparatus 1610 used for in-situ endpoint detection that includes a movable structure 1620 and a sensing apparatus 1630. The movable structure is coupled to the sensing apparatus and enables the sensing apparatus to be positioned in various places. For example, the movable structure may position the sensing apparatus in an active position (sensing position), or an inactive position (non-sensing position). The sensing apparatus detects a wafer processing endpoint using techniques described above, such as reflection color sensing. Other endpoint detection techniques may also be used. The sensing apparatus may include a photoelectric sensor, such as the color sensor described above with reference to FIG. 14. Again with reference to FIG. 16A, the sensing apparatus may be coupled to a decision circuit for deciding whether a wafer processing endpoint has been reached based at least in part on data generated by the sensing apparatus. FIG. 16B depicts a side view of an embodiment of the endpoint detection apparatus 1610 used for in-situ endpoint detection that includes the movable structure 1620 and the sensing apparatus 1630.

Figure 17A:
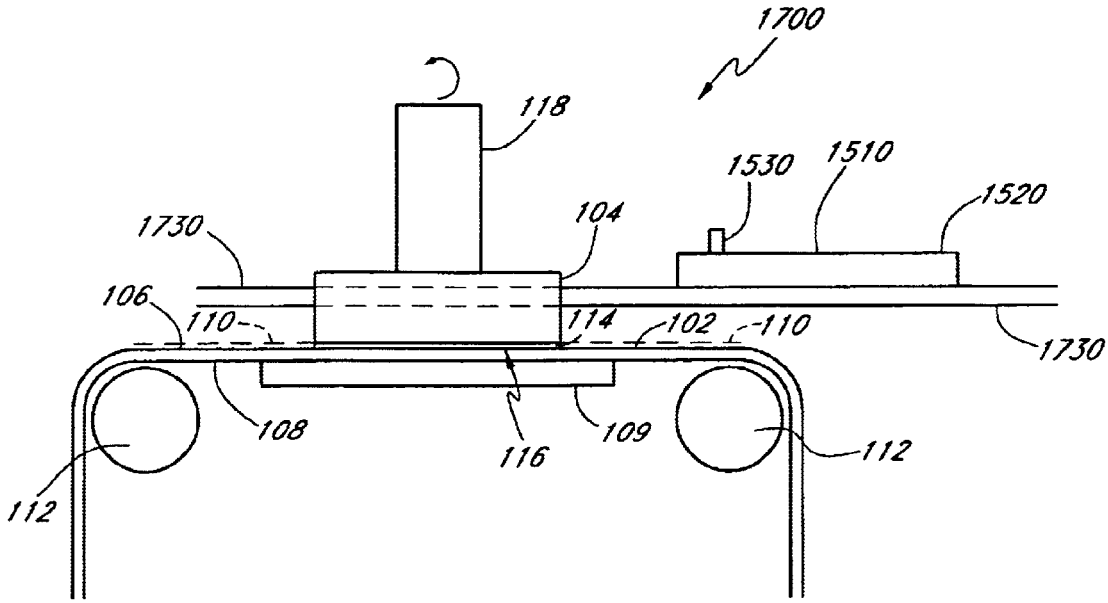
FIG. 17A depicts an embodiment of an endpoint detection apparatus situated in an exemplary CMP apparatus, where the CMP apparatus includes a carrier head, a polishing member, the endpoint detection apparatus, and a track, and where the CMP apparatus is in a polishing mode.

FIG. 17A depicts the endpoint detection apparatus 1710 situated in an exemplary CMP apparatus 1700, where the CMP apparatus includes the carrier head 104, the polishing member 102, the endpoint detection apparatus 1610, and a track 1730, and where the CMP apparatus is in a polishing mode. The track provides a path for the endpoint detection apparatus to travel on to perform in-situ endpoint detection. As stated above, FIG. 17A shows the CMP apparatus in a polishing mode, with the carrier head in a down position and the bottom surface 116 of wafer 114 in contact with the polishing surface 106 of polishing member 102. While the CMP apparatus is in the polishing mode depicted in FIG. 17A, the endpoint detection apparatus is in an inactive position, meaning that the endpoint detection apparatus is not in a position in which the sensing apparatus performs endpoint detection upon the bottom surface of the wafer.

Figure 17B:
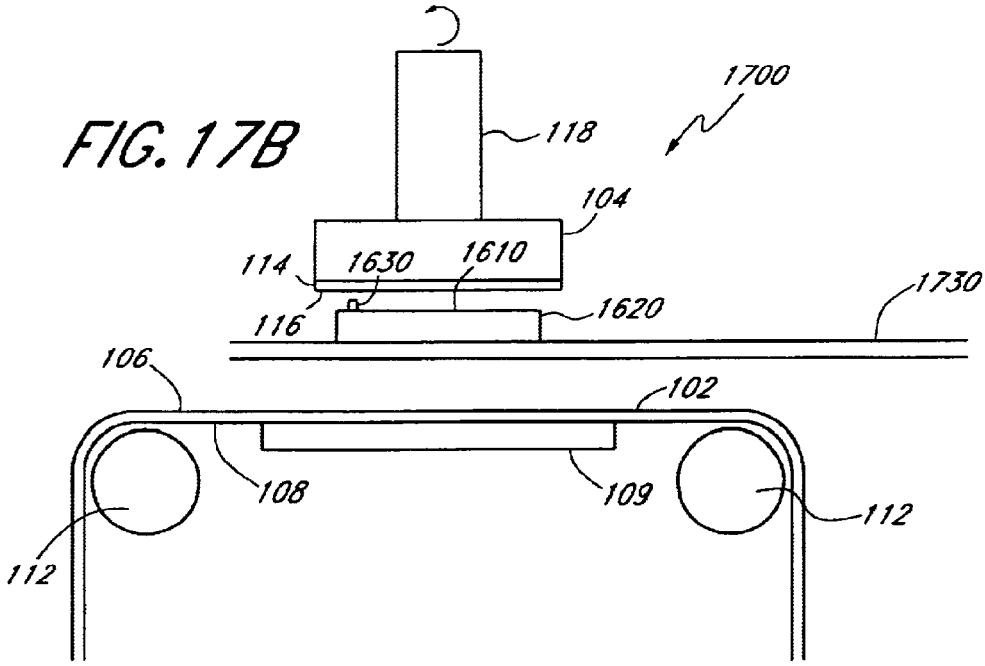
FIG. 17B depicts an embodiment of an endpoint detection apparatus situated in an exemplary CMP apparatus, where the CMP apparatus includes a carrier head, a polishing member, the endpoint detection apparatus, and a track, and where the CMP apparatus is in a non-polishing mode.

FIG. 17B depicts the endpoint detection apparatus 1610 situated in the exemplary CMP apparatus 1700, where the CMP apparatus includes the carrier head 104, the polishing member 102, the endpoint detection apparatus 1610, and the track 1730, and where the CMP apparatus 1700 is in a non-polishing mode. As stated above, FIG. 17B shows the CMP apparatus in a non-polishing mode, with the carrier head in a raised position and with the bottom surface of the wafer not in contact with the polishing surface of polishing member. With the carrier head in a raised position, the endpoint detection apparatus moves under the carrier head along the track and positions the sensing apparatus under the bottom surface of the wafer, thereby positioning the endpoint detection apparatus in an active position. While positioned under the bottom surface of the wafer, the sensing apparatus performs endpoint detection upon the semiconductor wafer. For example, the sensing apparatus may sense the reflection color from the wafer surface. Note that the wafer does not need to be unloaded from the carrier head in order for endpoint detection to be performed.

If the sensing apparatus determines that the endpoint has been reached, then the wafer may be unloaded from the carrier head and taken to a subsequent processing station. In one aspect, the movable structure may move (take) the semiconductor wafer to the subsequent processing station.

The movable structure may be any kind of member suitable for positioning the sensing apparatus for in-situ endpoint detection, such as a shuttle, arm, or other type of member. In one aspect, the movable structure is a cleaning shuttle which functions to move the wafer to a cleaning chamber (not shown) after the processing endpoint has been reached. In this aspect, the cleaning shuttle is adapted to serve as the movable structure to position the sensing apparatus. If the sensing apparatus determines, while the endpoint detection apparatus is in an active position, that the endpoint has been reached, then the wafer is unloaded onto the cleaning shuttle (i.e. the movable structure) and taken to the cleaning chamber to be cleaned. It shall be understood that the track is not necessary to the invention. For example, if the movable structure is an arm, no track may be required.

If the sensing apparatus determines that the endpoint has not been reached, then the endpoint detection apparatus is removed from beneath the carrier head (restored to an inactive position) and the carrier head is lowered to place the surface of the wafer back in contact with the polishing surface of the polishing member for additional polishing. A cycle of polishing the wafer and moving the endpoint detection apparatus into position to detect the wafer processing endpoint may continue until the endpoint is reached.

In another aspect of the invention, the shaft 118 and the carrier head spin the wafer, as indicated by the circular arrow above the shaft in FIGS. 17A and 17B. In this aspect, because the wafer is spinning, the endpoint detection apparatus can scan the entire surface of the wafer by moving in a straight path across a radius of the wafer. Alternatively, if the wafer does not spin, the endpoint detection apparatus may have a motor to spin the endpoint detection apparatus so that the entire wafer surface can be scanned. The endpoint detection apparatus may instead have multiple sensing apparatuses to scan the entire wafer surface.

Figure 18:
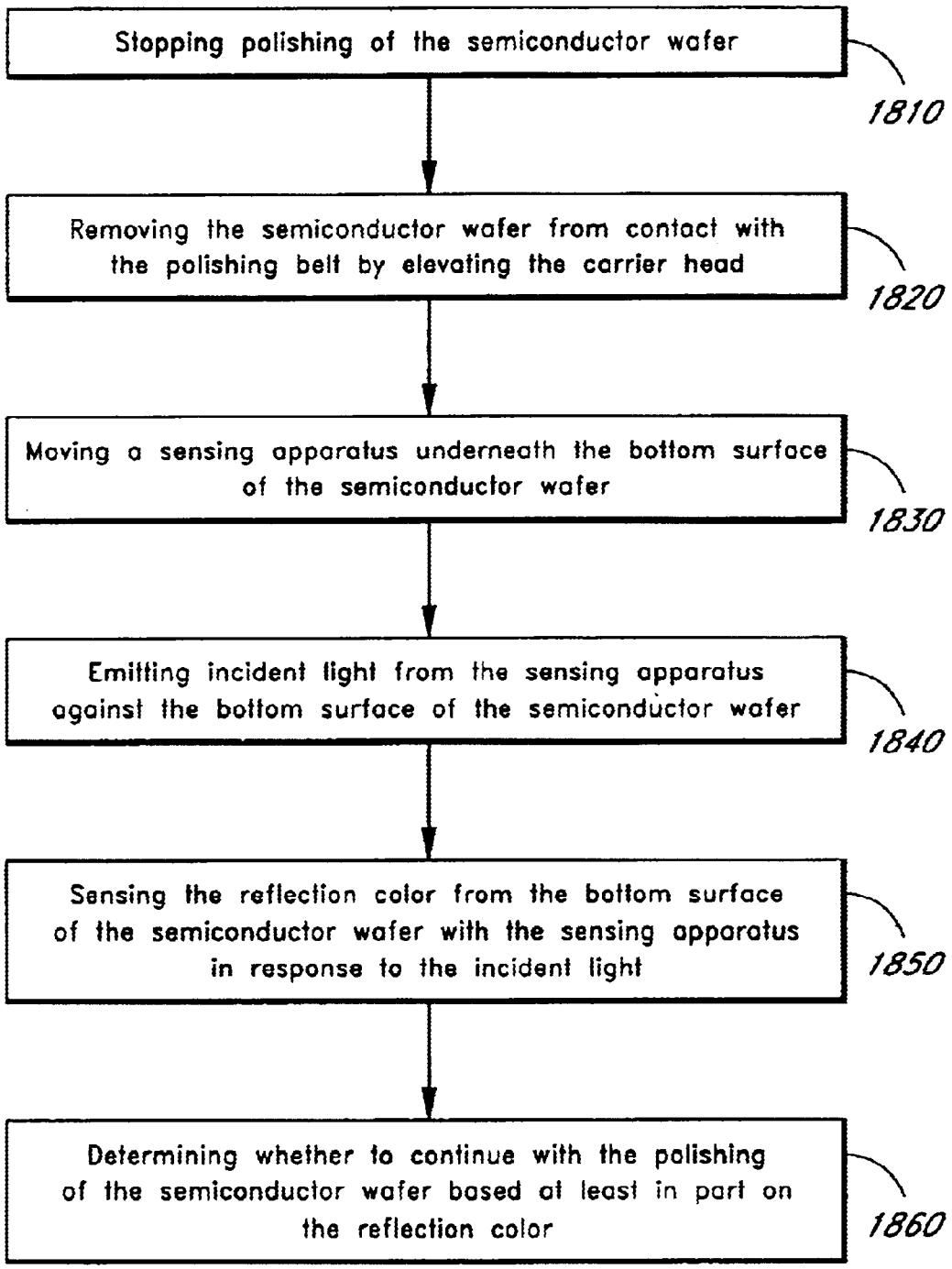
FIG. 18 is a flow diagram of an embodiment of a method for detecting a processing endpoint of a multi-layer semiconductor wafer in a CMP apparatus having a carrier head and a polishing member, and where the semiconductor wafer is attached to the carrier head.

FIG. 18 is a flow diagram of an embodiment of a method for detecting a processing endpoint of a multi-layer semiconductor wafer in a CMP apparatus, such as the exemplary CMP apparatus 1600, having a carrier head and a polishing member, and where the semiconductor wafer is attached to the carrier head. In step 1810, polishing of the semiconductor wafer is stopped. In step 1820, the semiconductor wafer is removed from contact with the polishing member by elevating the carrier head. In step 1830, a sensing apparatus is moved underneath a bottom surface of the semiconductor wafer. In step 1840, incident light is emitted from the sensing apparatus against the bottom surface of the semiconductor wafer. In step 1850, a reflection color is sensed from the bottom surface of the semiconductor wafer with the sensing apparatus in response to the incident light. In step 1860, a determination is made of whether to continue with the polishing of the semiconductor wafer based at least in part on the reflection color. In one aspect, the method further includes discontinuing the polishing of the semiconductor wafer and moving the semiconductor wafer to another processing station if a desired reflection color is sensed.

I. Conclusion

Advantages of the invention include the ability to provide optimal workpiece polishing to a selected endpoint.

It is to be understood that in the foregoing discussion and appended claims, the terms "wafer surface" and "surface of the wafer" include, but are not limited to, the surface of the wafer prior to processing and the surface of any layer formed on the wafer, including conductors, oxidized metals, oxides, spin-on glass, ceramics, etc. The terms "wafer", "semiconductor wafer", and "substrate" are used interchangeably.

It is understood that the embodiments and aspects of the invention described herein may be combined to operate together in any suitable manner. For example, the sensing apparatus 1400 and/or the movable structure 1620 may be combined with the smart endpoint detection system and/or the carrier head pressure variation system described above to provide for thickness uniformity across the semiconductor wafer. The preceding combinations are examples only. Other combinations and embodiments are also contemplated.

It is also understood that although specific wafer processes, such as chemical mechanical polishing, have been discussed, the invention may be implemented in connection with any other type of wafer process, such as electro-chemical mechanical deposition (ECMD).

Having disclosed exemplary embodiments and the best mode, modifications and variations may be made to the disclosed embodiments while remaining within the subject and spirit of the invention as defined by the following claims.

What is claimed is:

1. A polishing apparatus for polishing a workpiece comprising:

a workpiece holder configured to hold the workpiece;

a flexible polishing pad configured to be positioned adjacent to a surface of the workpiece to polish the workpiece with a front side of the polishing pad;

a platen having a plurality of holes positioned on a back side of the polishing pad and configured to supply and exhaust a fluid through the holes to selectively apply pressure to the polishing pad;

an endpoint sensor for detecting a processing endpoint of the workpiece;

a mechanism coupled to the endpoint sensor and configured to move the endpoint sensor between the front side of the polishing pad and the surface of the workpiece; and a fluid controller coupled to the sensor and configured to adjust the fluid pressure based in part on signals from the endpoint sensor.

2. The polishing apparatus of claim 1 further comprising a light source coupled to the mechanism and configured to emit a light against a surface of the workpiece wherein the endpoint sensor determines the processing endpoint in response to a reflected light.

3. The polishing apparatus of claim 2, wherein the light source emits multi-spectrum incident light and the endpoint sensor senses a multi-spectrum reflection.

4. The polishing apparatus of claim 3, further comprising a decision circuit having a comparator to compare the multi-spectrum reflection from the surface of the workpiece against a threshold reflection color, and wherein a decision whether the processing endpoint has been reached is based upon reflection color comparison data from the comparator.

5. The polishing apparatus of claim 4, wherein the threshold reflection color is based upon at least one of the group consisting of:

silicon dioxide ($SiO_2$);

silicon nitride ($Si_3N_4$);

copper (Cu);

tantalum (Ta);

tantalum nitride (TaN);

tantalum/tantalum nitride (Ta/TaN); and an insulating layer.

6. The polishing apparatus of claim 3, wherein the endpoint sensor is configured to sense light in the wavelength range spanning from 400–800 nm.

7. The polishing apparatus of claim 2, wherein the light source emits white incident light and the endpoint sensor senses a red-green-blue (RGB) reflection.

8. The polishing apparatus of claim 2, wherein the light source and the endpoint sensor are configured to scan the surface of the semiconductor wafer.

9. The polishing apparatus of claim 2, further comprising a color sensor to sense a reflection color from the surface of the workpiece and generate a sensor signal.

10. The polishing apparatus of claim 9, wherein the decision circuit further comprises a comparator to compare the reflection color from the surface of the workpiece against a threshold reflection color, and wherein the decision whether the processing endpoint has been reached is based upon reflection color comparison data from the computer.

11. The polishing apparatus of claim 10, wherein the threshold reflection color is based upon at least one of the group consisting of:

silicon dioxide ($SiO_2$);

silicon nitride ($Si_3N_4$);

copper (Cu);

tantalum (Ta);

tantalum nitride (TaN);

tantalum/tantalum nitride (Ta/TaN); and an insulating layer.

12. The polishing apparatus of claim 10, wherein the polishing apparatus is configured to polish a workpiece having a hydrophilic layer and a hydrophobic layer.

13. The polishing apparatus of claim 10, wherein the workpiece includes an upper copper (Cu) layer and a lower barrier layer, and wherein the threshold reflecting color is based on barrier layer reflection.

14. A polishing apparatus of claim 9, further comprising a decision circuit coupled to the color sensor and configured to decide whether the workpiece processing endpoint has been reached based at least in part on the sensor signal.

15. The polishing apparatus of claim 1, wherein the polishing apparatus is configured to polish a workpiece having a hydrophilic layer and a hydrophobic layer.

16. A polishing apparatus for polishing a surface of a workpiece, comprising:

a flexible polishing pad configured to be positioned adjacent to the surface of the workpiece to polish the surface of the workpiece with a front side of the polishing pad;

a platen having a plurality of holes positioned on a back side of the polishing pad and configured to supply and exhaust a fluid through the holes to selectively apply pressure to the polishing pad;

an endpoint sensor configured to detect a processing endpoint of the workpiece when the polishing apparatus is in a non-polishing mode; and a fluid controller coupled to the endpoint sensor and configured to adjust the fluid pressure based in part on signals from the endpoint sensor.

17. The polishing apparatus of claim 16, further comprising a mechanism coupled to the endpoint sensor and configured to move the endpoint sensor between the front side of the polishing pad and the surface of the workpiece.

18. The polishing apparatus of claim 17, further comprising a light source coupled to the mechanism and configured to emit a light against the surface of the workpiece wherein the endpoint sensor determines the processing endpoint in response to a reflected light.

19. The polishing apparatus of claim 18, wherein the light source emits multi-spectrum incident light and the endpoint sensor senses a multi-spectrum reflection.

20. The polishing apparatus of claim 18, wherein the light source emits white incident light and the endpoint sensor senses a red-green-blue (RGB) reflection.

* * * * *